US008317501B2

(12) United States Patent
Inoue

(10) Patent No.: US 8,317,501 B2
(45) Date of Patent: Nov. 27, 2012

(54) DAMPER DEVICE, HIGH PRESSURE PUMP HAVING THE SAME AND MANUFACTURING METHOD OF THE SAME

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 226 days.

(21) Appl. No.: 12/712,517

(22) Filed: Feb. 25, 2010

(65) Prior Publication Data

US 2010/0215529 A1 Aug. 26, 2010

(30) Foreign Application Priority Data

Feb. 25, 2009 (JP) ..... 2009-42247
Nov. 9, 2009 (JP) ..... 2009-256383

(51) Int. Cl.
*F04B 11/00* (2006.01)

(52) U.S. Cl. ..... 417/543; 417/542; 417/540

(58) Field of Classification Search ..... 417/540, 417/542, 543; 138/30; 92/60, 96, 97
See application file for complete search history.

(56) References Cited

U.S. PATENT DOCUMENTS 2,501,773 A * 3/1950 Johnson ..... 138/30
4,278,406 A * 7/1981 Cooperrider ..... 417/199.2
7,124,738 B2 10/2006 Usui et al.
7,165,534 B2 * 1/2007 Usui et al. ..... 123/467
7,401,594 B2 7/2008 Usui et al.
2005/0019188 A1 1/2005 Usui et al.
2006/0201485 A1 * 9/2006 Usui et al. ..... 123/458
2007/0079810 A1 * 4/2007 Usui et al. ..... 123/467
2008/0289713 A1 11/2008 Munakata et al.

FOREIGN PATENT DOCUMENTS

JP 2004-138071 5/2004
JP 2005-042554 2/2005
JP 2008-286144 11/2008

OTHER PUBLICATIONS

DE 10 2007 003 724 A1.*
Machine translation of DE 10 2007 003 724 A1.*

* cited by examiner

*Primary Examiner* — Charles Freay
*Assistant Examiner* — Christopher Bobish
(74) *Attorney, Agent, or Firm* — Nixon & Vanderhye P.C.

(57) ABSTRACT

Gas of a predetermined pressure, which is equal to or higher than the atmospheric pressure, is filled in a damper chamber of a damper member that includes first and second-side diaphragms. A first-side limiting portion of a first-side cover member and a second-side limiting portion of a second-side cover member are engageable with a first-side concave portion of the first-side diaphragm and a second-side concave portion of the second-side diaphragm, respectively, to limit bulging of the damper member when a pressure of a fluid chamber is equal to or less than the predetermined pressure.

23 Claims, 11 Drawing Sheets

DAMPER DEVICE, HIGH PRESSURE PUMP HAVING THE SAME AND MANUFACTURING METHOD OF THE SAME

CROSS REFERENCE TO RELATED APPLICATION

This application is based on and incorporates herein by reference Japanese Patent Application No. 2009-42247 filed on Feb. 25, 2009 and Japanese Patent Application No. 2009-256383 filed on Nov. 9, 2009.

BACKGROUND OF THE INVENTION

1. Field of the Invention

The present invention relates to a damper device, a high pressure pump having the damper device and a manufacturing method of the high pressure pump.

2. Description of Related Art

For example, Japanese Unexamined Patent publication No. 2005-42554A (corresponding to US 2005/0019188A1) teaches a high pressure pump that includes a damper device, which damps, i.e., reduces pressure pulsation of fuel generated through reciprocating movement of a plunger.

In this damper device, two metal diaphragms are joined together to form a damper member, which is placed in a fluid chamber of the high pressure pump. Gas is filled in a damper chamber of the damper member. A pressure of the gas, which is filled in the damper chamber, is equal to or higher than the atmospheric pressure. Each diaphragm is configured into a dish form and includes a generally circular region and an outer peripheral region. The generally circular region serves as a movable portion, and the outer peripheral region is located radially outward of the generally circular region and serves as a non-movable portion. When the pressure of the fuel in the fluid chamber is changed, the movable portions of these two diaphragms are displaced relative to each other, thereby resulting in a change in the volume of the damper chamber of the damper member. In this way, the damper member implements the pressure pulsation damping effect (reducing effect) for damping the pressure pulsation of the fuel in the fluid chamber.

For instance, when the engine of the vehicle, which has the high pressure pump discussed above, is stopped, the pressure of the fluid chamber, in which the damper member is placed, becomes generally equal to the atmospheric pressure (this state of the fluid chamber will be hereinafter referred to as a non-operating state). Therefore, at this time, the damper member is bulged, so that the movable portions of the two diaphragms are bulged away from each other, i.e., are displaced away from each other in a separating direction. In this state, the stress is generated at or around the boundary between each movable portion and its adjacent non-movable portion in the damper member. Thereafter, when the operation of the high pressure pump is started, the pressure of the fuel in the fluid chamber is increased. This state of the fluid chamber at the time of starting the operation of the high pressure pump will be hereinafter referred to as an operation start time state. At this time, the movable portions of the two diaphragms are displaced toward each other in an approaching direction, and thereby the volume of the damper chamber is reduced. During the operation of the high pressure pump, the pressure of the fuel in the fluid chamber is repeatedly changed, i.e., is repeatedly decreased and then increased. The state of the fluid chamber during the operation of the high pressure pump will be hereinafter referred to as an operating state. When the movable portions of the two diaphragms are repeatedly moved toward each other and then moved away from each other in response to the repeated change of the pressure of the fuel in the fluid chamber, the volume of the damper chamber is repeatedly decreased and then increased.

When the state of the fluid chamber is changed from the non-operating state to the operation start time state or is in the operating state, the movable portions of the diaphragms of the damper member are displaced. Therefore, the stress, which is generated in the damper member, is also changed. The amount of displacement of the movable portions of the diaphragms at the time of changing from the non-operating state to the operation start time state is larger than the amount of displacement of the movable portions of the diaphragms in the operating state. Therefore, the amount of each displacement of the movable portions of the diaphragms as well as the number of times of displacement of the movable portions of the diaphragms at the time of changing from the non-operating state to the operation start time state have large influences on the lifetime of the damper member.

For instance, nowadays, the engine idling of the vehicle is temporarily stopped at, for example, the red traffic light for the purpose of improving the fuel consumption. In such a case, the number of times of change from the non-operating state to the operation start time is increased. Furthermore, the supply pressure of the fuel, which is supplied to the high pressure pump at the time of the engine start, is increased to improve the starting performance of the engine. In such a case, the amount of displacement of the movable portions of the diaphragms becomes large at the time of changing the state of the fluid chamber from the non-operating state to the operation start time state. Under such a condition, the lifetime of the damper member may be particularly reduced. It is conceivable to use a material, which exhibits a high fatigue strength, as the material of the diaphragms in order to lengthen the lifetime of the damper member. However, when the material, which exhibits the high fatigue strength, is used as the material of the diaphragms, the manufacturing costs of the damper device may be disadvantageously increased.

SUMMARY OF THE INVENTION

The present invention addresses the above disadvantages. According to the present invention, there is provided a damper device, which includes a damper housing, an opening cover member, a damper member, a first-side cover member, a second-side cover member, a first-side support member and a second-side support member. The damper housing has an opening at one end of the damper housing. The opening cover member covers the opening and forms a fluid chamber in cooperation with the damper housing. The fluid chamber is adapted to conduct fluid therethrough. The damper member is placed in the damper chamber and includes a first-side diaphragm and a second-side diaphragm, which are resiliently deformable. A first-side outer peripheral portion of the first-side diaphragm and a second-side outer peripheral portion of the second-side diaphragm are joined with each other to seal a damper chamber between a first-side concave portion of the first-side diaphragm and a second-side concave portion of the second-side diaphragm. The first-side cover member is provided on one side of the first-side diaphragm, which is opposite from the second-side diaphragm, and includes a first-side outer peripheral portion and a first-side limiting portion. The first-side outer peripheral portion of the first-side cover member is engaged with the first-side outer peripheral portion of the first-side diaphragm. The first-side limiting portion radially inwardly extends from the first-side outer peripheral portion of the first-side cover member. The second-side cover member is provided on one side of the second-side diaphragm, which is opposite from the first-side diaphragm, and includes a second-side outer peripheral portion and a second-side limiting portion. The second-side outer peripheral portion of the second-side cover member is engaged with the second-side outer peripheral portion of the second-side diaphragm, and the second-side limiting portion radially inwardly extends from the second-side outer peripheral portion of the second-side cover member. The first-side support member is configured into a generally tubular form and is placed between the first-side cover member and the opening cover member. The first-side support member urges the first-side outer peripheral portion of the first-side cover member toward the first-side outer peripheral portion of the first-side diaphragm. The second-side support member is configured into a generally tubular form and is placed between the second-side cover member and the damper housing. The second-side support member urges the second-side outer peripheral portion of the second-side cover member toward the second-side outer peripheral portion of the second-side diaphragm to clamp the first-side outer peripheral portion of the first-side cover member, the first-side outer peripheral portion of the first-side diaphragm, the second-side outer peripheral portion of the second-side diaphragm and the second-side outer peripheral portion of the second-side cover member between the first-side support member and the second-side support member. Gas of a predetermined pressure, which is equal to or higher than an atmospheric pressure, is filled in the damper chamber of the damper member. The first-side limiting portion and the second-side limiting portion are engageable with the first-side concave portion and the second-side concave portion, respectively, to limit bulging of the damper member when a pressure of the fluid chamber is equal to or less than the predetermined pressure.

There is also provided a high pressure pump, which includes the damper device described above, a housing and a plunger. The housing includes a pressurizing chamber, which is communicated with the fluid chamber. The plunger is received in the housing and is adapted to reciprocate in the housing to pressurize fluid in the pressurizing chamber.

There is also provided a manufacturing method for manufacturing the high pressure pump described above. According to this method, gas of a predetermined pressure, which is equal to or higher than an atmospheric pressure, is filled into the damper chamber of the damper member. A pressure of the fluid chamber is variable within a predetermined pressure range during operation of the high pressure pump, and the predetermined pressure of the gas is lower than a lower limit value of the predetermined pressure range.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1A:
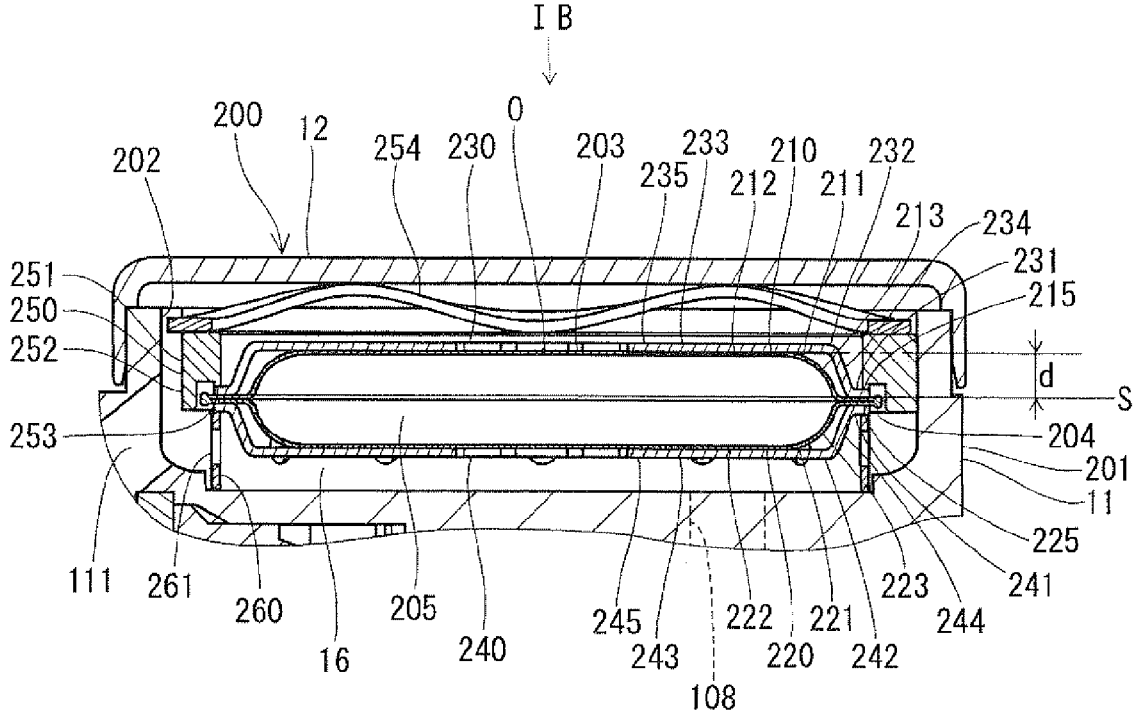
FIG. 1A is a cross-sectional view showing a damper device of a high pressure pump according to a first embodiment of the present invention.

Embodiments of the present invention will be described with reference to the accompanying drawings. In the following embodiments, similar components will be indicated by the same reference numerals and will not be described redundantly for the sake of simplicity.

(First Embodiment)

Figure 2:
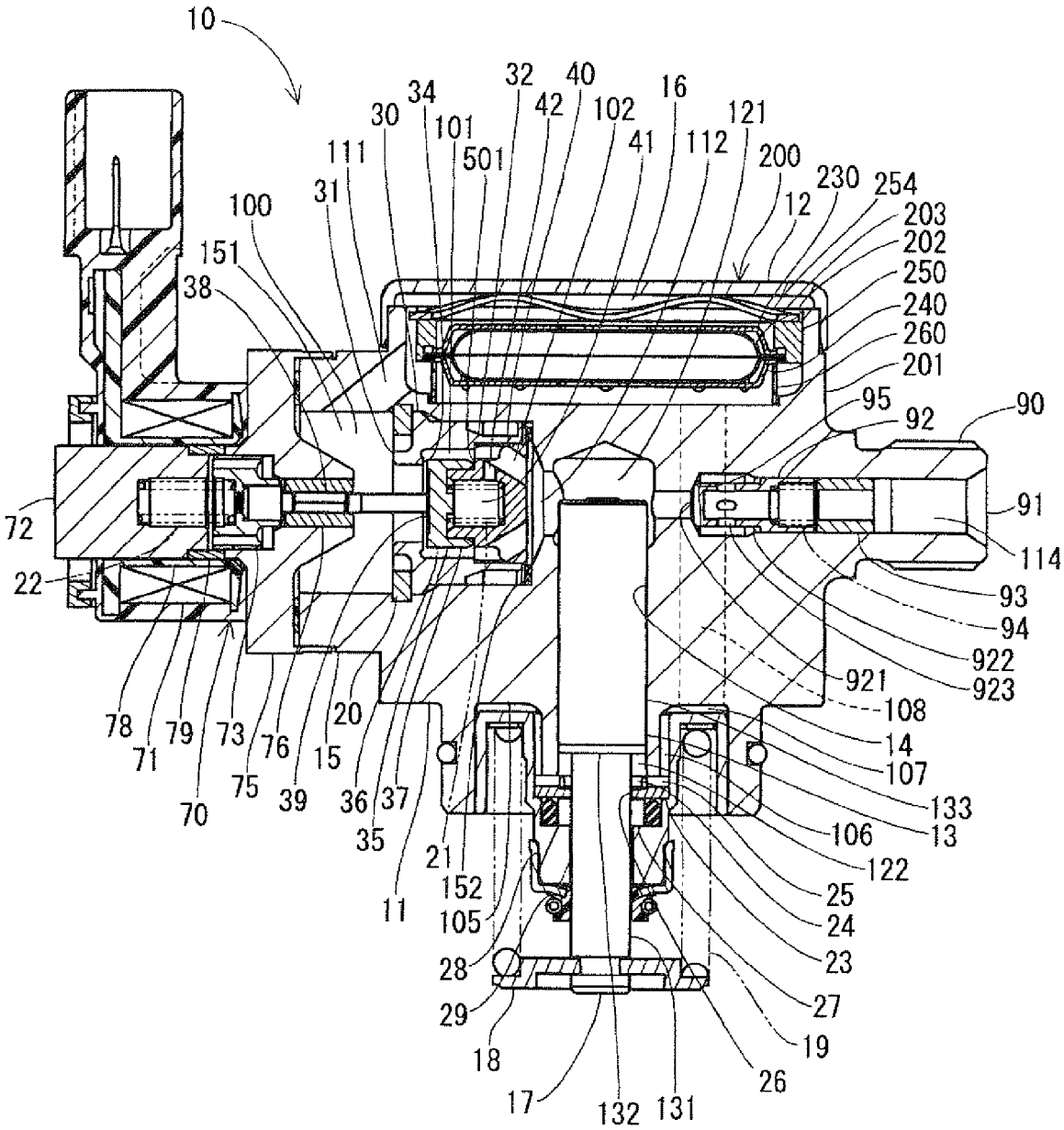
FIG. 2 is a cross sectional view of the high pressure pump of the first embodiment.

In a first embodiment of the present invention, a damper device is implemented in a high pressure pump of a vehicle. The high pressure pump supplies fuel to, for example, an injector of a diesel engine or a gasoline engine of a vehicle through a delivery pipe. As shown in FIG. 2, the high pressure pump 10 includes a housing 11, a plunger 13, a valve body 30, a valve member 35, an electromagnetic drive device 70 and the damper device 200.

The housing 11 is made of metal, such as stainless steel. The housing 11 forms a cylinder 14. The plunger 13 is supported in the cylinder 14 of the housing 11 in such a manner that the plunger 13 is axially reciprocatable in the cylinder 14.

The housing 11 forms a guide passage 111, an intake passage 112, a pressurizing chamber 121 and a delivery passage 114. The housing 11 has a tubular portion 15. The tubular portion 15 forms a passage 151, which communicates between the guide passage 111 and the intake passage 112. The tubular portion 15 extends in a direction generally perpendicular to a central axis of the cylinder 14. An inner diameter of the tubular portion 15 changes along a length of the tubular portion 15. In the housing 11, a stepped surface 152 is formed in the interior of the tubular portion 15 at a location where the inner diameter of the tubular portion 15 changes. A valve body 30 is provided in the passage 151, which is formed in the tubular portion 15.

A fuel chamber 16 is formed between the housing 11 and an opening cover member 12. The fuel chamber 16 serves as a fluid chamber. A damper housing 201 forms a part of the housing 11. Specifically, the damper device 200 includes the damper housing 201 (housing 11), the opening cover member 12, a damper member 203, a first-side cover member 230, a second-side cover member 240, a first-side support member 250 and a second-side support member 260. The damper device 200 will be described in detail later.

A fuel inlet (not shown) is formed in the fuel chamber 16 and is communicated with a low pressure fuel conduit (not shown). A low pressure fuel pump (not shown) pumps fuel out of a fuel tank and supplies the fuel to the fuel chamber 16 through the low pressure fuel conduit and the fuel inlet. The guide passage 111 communicates between the fuel chamber 16 and the passage 151 of the tubular portion 15. One end part of the intake passage 112 is opened on an inner peripheral side of the stepped surface 152. The other end part of the intake passage 112 is communicated with the pressurizing chamber 121. The guide passage 111 and the intake passage 112 are communicated with each other through the interior of the valve body 30. Thereby, the fuel chamber 16 is communicated with the pressurizing chamber 121 through the guide passage 111, the passage 151 and the intake passage 112. In the present embodiment, these passages (the guide passage 111, the passage 151 and the intake passage 112) are collectively referred to as a fuel passage 100. The pressurizing chamber 121 is communicated with the delivery passage 114 on a side that is opposite from the intake passage 112.

The plunger 13 is supported in the cylinder 14 of the housing 11 in such a manner that the plunger 13 is axially reciprocatable in the cylinder 14. The plunger 13 has a small diameter portion 131 and a large diameter portion 133. The large diameter portion 133 has an outer diameter, which is larger than an outer diameter of the small diameter portion 131. The large diameter portion 133 is connected to a pressurizing chamber 121 side end of the small diameter portion 131 and forms a stepped surface 132 between the large diameter portion 133 and the small diameter portion 131. The pressurizing chamber 121 is formed at an end of the large diameter portion 133, which is opposite from the small diameter portion 131. A plunger stopper 23, which is configured into a generally annular form and is engaged with the housing 11, is provided on one side of the stepped surface 132 of the plunger 13, which is opposite from the pressurizing chamber 121.

The plunger stopper 23 has a recess 24 and a groove passage 25. The recess 24 is configured into an annular form and is recessed in a pressurizing chamber 121 side end surface of the plunger stopper 23 in a direction, which is opposite from the pressurizing chamber 121. The groove passage 25 extends radially outwardly from the recess 24 to an outer peripheral edge part of the plunger stopper 23. A diameter of the recess 24 is generally the same as the outer diameter of the large diameter portion 133 of the plunger 13. A through hole 26 is formed at a center portion of the recess 24 to extend through the plunger stopper 23 in a thickness direction of the plunger stopper 23 (i.e., in the axial direction of the plunger 13). The small diameter portion 131 of the plunger 13 is received through the through hole 26 of the plunger stopper 23, and the pressurizing chamber 121 side end surface of the plunger stopper 23 is engaged with the housing 11. In this way, a variable volume chamber 122, which is configured into a generally annular shape, is defined by the stepped surface 132 of the plunger 13, an outer peripheral wall of the small diameter portion 131, an inner peripheral wall of the cylinder 14, the recess 24 of the plunger stopper 23 and a seal member 27.

A recess 105, which is configured into a generally annular form, is recessed in an end part of the housing 11, which is opposite from the pressurizing chamber 121, at a location radially outward of the cylinder 14. An oil seal holder 28 is fitted into the recess 105. The oil seal holder 28 is fixed to the housing 11 while the seal member 27 is clamped between the oil seal holder 28 and the plunger stopper 23. The seal member 27 includes a Teflon ring (Teflon is a registered trademark and brand name of the DuPont company) and an O-ring. The O-ring is placed radially outward of the Teflon ring. The seal member 27 limits a thickness of a fuel oil film around the small diameter portion 131 and limits leakage of fuel toward the engine, which would be induced by the slide movement of the plunger 13. An oil seal 29 is installed to an end part of the oil seal holder 28, which is opposite from the pressurizing chamber 121. The oil seal 29 limits a thickness of an oil film around the small diameter portion 131 and also limits leakage of the oil, which would be induced by the slide movement of the plunger 13.

Annular passages 106, 107 are formed between the oil seal holder 28 and the housing 11. The passage 106 and the passage 107 are communicated with each other. A passage 108, which communicates between the passage 107 and the fuel chamber 16, is formed in the housing 11. The passage 106 and the groove passage 25 of the plunger stopper 23 are communicated with each other. The groove passage 25, the passage 106, the passage 107 and the passage 108 are communicated in the above described manner to communicate the variable volume chamber 122 with the fuel chamber 16.

A head 17, which is provided at the other end of the small diameter portion 131 that is opposite from the large diameter portion 133, is connected to a spring seat 18. A spring 19 is placed between the spring seat 18 and the oil seal holder 28. The spring seat 18 is urged downwardly in FIG. 2 toward a cam (not shown) by an urging force of the spring 19. The plunger 13 is engaged with the cam through a tappet (not shown) and is thereby reciprocated by the cam. One end part of the spring 19 is engaged with the oil seal holder 28, and the other end part of the spring 19 is engaged with the spring seat 18. The spring 19 exerts an axial resilient force. In this way, the spring 19 urges the tappet (not shown) toward the cam through the spring seat 18.

The volume of the variable volume chamber 122 is changed in response to the reciprocating movement of the plunger 13. The fuel is drawn into the variable volume chamber 122 from the fuel chamber 16 (the fuel chamber 16 being communicated with the fuel passage 100) through the passage 108, the passage 107, the passage 106 and the groove passage 25 when the volume of the variable volume chamber 122 is increased upon the upward movement of the plunger 13 in a metering stroke or a pressurizing stroke of the plunger 13. In the metering stroke of the plunger 13, a portion of the low pressure fuel, which is discharged from the pressurizing chamber 121, can be drawn into the variable volume chamber 122. In this way, even when fuel pressure pulsation occurs due to the discharge of the fuel from the pressurizing chamber 121, it is possible to limit transmission of the fuel pressure pulsation to the low pressure fuel conduit.

The fuel is discharged from the variable volume chamber 122 to the fuel chamber 16 when the volume of the variable volume chamber 122 is decreased upon the increase of the volume of the pressurizing chamber 121 caused by the downward movement of the plunger 13 in the intake stroke in FIG. 2. Here, the volume of the pressurizing chamber 121 and the volume of the variable volume chamber 122 are determined solely by the position of the plunger 13. Therefore, the fuel is discharged from the variable volume chamber 122 to the fuel chamber 16 at the time of drawing of the fuel into the pressurizing chamber 121, so that the pressure decrease in the fuel chamber 16 is limited, and thereby the quantity of fuel, which is drawn into the pressurizing chamber 121 through the fuel passage 100, is increased. Thereby, a fuel suctioning efficiency for suctioning, i.e., drawing the fuel into the pressurizing chamber 121 is improved.

The delivery valve arrangement 90, which forms the fuel outlet 91 and is provided to the delivery passage 114 side portion of the housing 11, enables or disables the discharge of the pressurized fuel from the pressurizing chamber 121. The delivery valve arrangement 90 enables and disables discharging of fuel, which is pressurized in the pressurizing chamber 121. The delivery valve arrangement 90 includes a check valve 92, a limiting member 93 and a spring 94. The check valve 92 includes a bottom portion 921 and a tubular portion 922 extending from the bottom portion 921 on a side opposite from the pressurizing chamber 121 and is thereby configured into a cup shape. The check valve 92 is reciprocatable and placed in the delivery passage 114. The limiting member 93 is configured into a tubular form and is fixed to the housing 11, which forms the delivery passage 114. One end part of the spring 94 is engaged with the limiting member 93, and the other end part of the spring 94 is engaged with the tubular portion 922 of the check valve 92. The check valve 92 is urged toward a valve seat 95, which is formed in the housing 11, by the urging force of the spring 94. When the bottom portion 921 side end part of the check valve 92 is seated against the valve seat 95, the check valve 92 closes the delivery passage 114. In contrast, when the bottom portion 921 side end part of the check valve 92 is lifted away from the valve seat 95, the delivery passage 114 is opened. When the check valve 92 is moved in the direction opposite from the valve seat 95, the end part of the tubular portion 922, which is opposite from the bottom portion 921, is engaged with the limiting member 93 to limit further movement of the check valve 92.

When the pressure of the fuel in the pressurizing chamber 121 is increased, the force, which is applied to the check valve 92 from the fuel at the pressurizing chamber 121 side, is increased. When the force, which is applied to the check valve 92 from the fuel at the pressurizing chamber 121 side, becomes larger than a sum of the urging force of the spring 94 and the force, which is applied to the check valve 92 from the fuel on the downstream side of the valve seat 95, i.e., the fuel in a delivery pipe (not shown), the check valve 92 is lifted away from the valve seat 95. In this way, the fuel in the pressurizing chamber 121 is discharged out of the high pressure pump 10 through the fuel outlet 91 upon passing through radial through holes 923 of the tubular portion 922 and an interior of the tubular portion 922 in the check valve 92.

When the pressure of the fuel in the pressurizing chamber 121 is reduced, the force, which is applied to the check valve 92 from the fuel at the pressurizing chamber 121 side, is reduced. When the force, which is applied to the check valve 92 from the fuel in the pressurizing chamber 121, becomes smaller than the sum of the urging force of the spring 94 and the force, which is applied to the check valve 92 from the fuel on the downstream side of the valve seat 95, the check valve 92 is seated against the valve seat 95. In this way, it is possible to limit the outflow of the fuel from the interior of the delivery pipe (not shown) into the pressurizing chamber 121 through the delivery passage 114.

The valve body 30 is fixed to the interior of the passage 151 of the housing 11 by, for example, press-fitting of the valve body 30 into the passage 151 and also by use of an engaging member 20. The valve body 30 includes a valve seat portion 31 and a tubular portion 32. The valve seat portion 31 is configured into a generally annular form, and the tubular portion 32 is configured into a tubular form and extends from the valve seat portion 31 toward the pressurizing chamber 121. A valve seat 34 is configured into an annular form and is formed in a pressurizing chamber 121 side wall surface of the valve seat portion 31.

A valve member 35 is placed radially inward of the tubular portion 32 of the valve body 30. The valve member 35 includes a circular disk portion 36 and a guide portion 37. The circular disk portion 36 is configured into a generally circular plate form. The guide portion 37 is configured into a hollow tubular form and extends from an outer peripheral edge part of the circular disk portion 36 toward the pressurizing chamber 121. The valve member 35 has a recess 39, which is configured into a generally circular flat form at a valve seat 34 side end part of the circular disk portion 36 and is recessed in a direction opposite from the valve seat 34. An inner peripheral wall of the circular disk portion 36, which forms the recess 39, is tapered such that an inner diameter of the inner peripheral wall of the circular disk portion 36 is progressively decreased toward the pressurizing chamber 121. An annular fuel passage 101 is defined between the inner peripheral wall of the tubular portion 32 of the valve body 30 and the outer peripheral wall of the circular disk portion 36 and of the guide portion 37. The valve member 35 enables and disables the flow of fuel in the fuel passage 100 by disengaging and engaging the circular disk portion 36 relative to the valve seat 34 through the reciprocating movement of the valve member 35. The recess 39 receives the dynamic pressure of fuel, which flows from the passage 151 to the annular fuel passage 101.

The stopper 40 is provided on a pressurizing chamber 121 side of the valve member 35. The stopper 40 is fixed to the inner peripheral wall of the tubular portion 32 of the valve body 30.

An inner diameter of the guide portion 37 of the valve member 35 is set to be slightly larger than an outer diameter of a valve member 35 side end part of the stopper 40. Therefore, the inner peripheral wall of the guide portion 37 slides over the outer peripheral wall of the stopper 40 when the valve member 35 is reciprocated in a valve opening direction (i.e., a direction away from the valve seat 34) or a valve closing direction (i.e., a direction toward the vale seat 34). In this way, the reciprocating movement of the valve member 35 in the valve opening direction or the valve closing direction is guided.

A spring 21 is provided between the stopper 40 and the valve member 35. The spring 21 is placed radially inward of the guide portion 37 of the valve member 35 and also radially inward of the stopper 40. One end part of the spring 21 is engaged with the inner wall of the stopper 40, and the other end part of the spring 21 is engaged with the circular disk portion 36 of the valve member 35. The spring 21 has an axial expansion force (resilient force) to urge the valve member 35 in a direction opposite from the stopper 40, i.e., in the valve closing direction.

A pressurizing chamber 121 side end part of the guide portion 37 of the valve member 35 is engageable with a stepped surface 501, which is provided in the outer wall of the stopper 40. When the valve member 35 is engaged with the stepped surface 501, the stopper 40 limits further movement of the valve member 35 toward the pressurizing chamber 121, i.e., further movement of the valve member 35 in the valve opening direction. When the stopper 40 is axially viewed from the pressurizing chamber 121 side thereof, the stopper 40 covers the pressurizing chamber 121 side wail surface of the valve member 35. In this way, it is possible to limit the influence of the dynamic pressure, which is generated by the flow of low pressure fuel from the pressurizing chamber 121 side toward the valve member 35 side in the metering stroke of the plunger 13, on the valve member 35. Furthermore, a volume chamber 41 is formed between stopper 40 and the valve member 35. A volume of the volume chamber 41 is changed by the reciprocating movement of the valve member 35.

A plurality of passages 102 is formed in the stopper 40 in such a manner that each passage 102 is declined relative to the axis of the stopper 40 and communicates between the annular fuel passage 101 and the intake passage 112. The passages 102 are arranged one after another in the circumferential direction of the stopper 40. Furthermore, a conduit 42, which communicates between the volume chamber 41 and the fuel passage 102, is formed in the stopper 40. Therefore, fuel in each passage 102 can flow into the volume chamber 41 through the conduit 42.

The fuel passage 100 includes the annular fuel passage 101 and the fuel passage 102. Thereby, the fuel passage 100 communicates between the fuel chamber 16 and the pressurizing chamber 121. When fuel flows from the fuel chamber 16 side toward the pressurizing chamber 121 side, the fuel passes the guide passage 111, the passage 151, the annular fuel passage 101, the passage 102 and the intake passage 112 in this order. In contrast, when fuel flows from the pressurizing chamber 121 side toward the fuel chamber 16 side, the fuel flows through the intake passage 112, the fuel passage 102, the annular fuel passage 101, the passage 151 and the guide passage 111 in this order.

The electromagnetic drive device 70 includes a coil 71, a stator core 72, a movable core 73 and a flange 75. The coil 71 is wound around a spool 78, which is made of resin. When the coil 71 is energized, the coil 71 generates a magnetic field. The stator core 72 is made of a magnetic material. The stator core 72 is received radially inward of the coil 71. The movable core 73 is made of a magnetic material. The movable core 73 is opposed to the stator core 72. The movable core 73 is received in a tubular member 79, which is made of a non-magnetic material, and also in the flange 75 in a manner that enables axial reciprocating movement of the movable core 73. The tubular member 79 limits the magnetic short-circuiting between the stator core 72 and the flange 75.

The flange 75 is made of a magnetic material and is installed to the tubular portion 15 of the housing 11. The flange 75 holds the electromagnetic drive device 70 relative to the housing 11 and closes an end part of the tubular portion 15. The flange 75 has a guide tube 76, which is provided at a center part of the flange 75 and is configured into a tubular form.

The needle 38 is configured into a generally cylindrical form and is placed radially inward of the guide tube 76. An inner diameter of the guide tube 76 is slightly larger than an outer diameter of the needle 38. In this way, the needle 38 slides along and reciprocates along the inner peripheral wall of the guide tube 76. Therefore, when the needle 38 reciprocates, the reciprocating movement of the needle 38 is guided by the guide tube 76.

One end part of the needle 38 is press fitted to or welded to the movable core 73, so that the needle 38 is installed integrally with the movable core 73. The other end part of the needle 38 is engageable with a valve seat 34 side wall surface of the circular disk portion 36 of the valve member 35.

A spring 22 is provided between the stator core 72 and the movable core 73. The spring 22 urges the movable core 73 toward the valve member 35. The urging force of the spring 22, which urges the movable core 73, is larger than the urging force of the spring 21, which urges the valve member 35. Specifically, the spring 22 urges the movable core 73 and the needle 38 toward the valve member 35, i.e., in the valve opening direction of the valve member 35 against the urging force of the spring 21. In this way, when the coil 71 is not energized, the stator core 72 and the movable core 73 are spaced from each other. Therefore, when the coil 71 is not energized, the needle 38, which is integrated with the movable core 73, is moved toward the valve member 35 by the urging force of the spring 22, and thereby the valve member 35 is lifted away from the valve seat 34 of the valve body 30. As discussed above, the needle 38 can urge the valve member 35 in the valve opening direction upon the engagement of the needle 38 against the circular disk portion 36 with the urging force of the spring 22.

Now, the damper device 200 will be described in detail.

As shown in FIG. 1A, the damper device 200 includes the damper housing 201 (housing 11), the opening cover member 12, the damper member 203, the first-side cover member 230, the second-side cover member 240, the first-side support member 250 and the second-side support member 260.

The damper housing 201 forms the part of the housing 11. The damper housing 201 has an opening 202 at one end of the damper housing 201. The opening cover member 12 is configured into a cup-shaped body (i.e., a body having a planar bottom and a cylindrical peripheral wall projecting from an outer peripheral edge part of the bottom) and is made of metal, such as stainless steel. The opening side end part of the opening cover member 12 is joined to the outer wall of the damper housing 201 by, for example, welding to close the opening 202 of the damper housing 201. In this way, the fuel chamber 16, which serves as the fluid chamber, is formed between the damper housing 201 and the opening cover member 12.

The guide passage 111, the passage 108 and the low pressure fuel conduit (not shown) are connected to the fuel chamber 16. Therefore, the fuel chamber 16 is communicated with the pressurizing chamber 121, the variable volume chamber 122 and the low pressure fuel pump, which pumps the fuel out of the fuel tank, so that the fuel, which serves as the fluid, flows through the fuel chamber 16. Thereby, when the volume of the pressurizing chamber 121 and the volume of the variable volume chamber 122 are changed through the reciprocating movement of the plunger 13, the pressure pulsation of the fuel is generated in the fuel chamber 16 (see FIG. 2).

The damper member 203 is placed in the fuel chamber 16. The damper member 203 includes a first-side diaphragm 210 and a second-side diaphragm 220. The first-side diaphragm 210 and the second-side diaphragm 220 are produced by configuring a metal plate (made of metal, such as stainless steel, which exhibits a high yield strength and a high fatigue strength) into a dish form through press working of the metal plate.

Figure 1B:
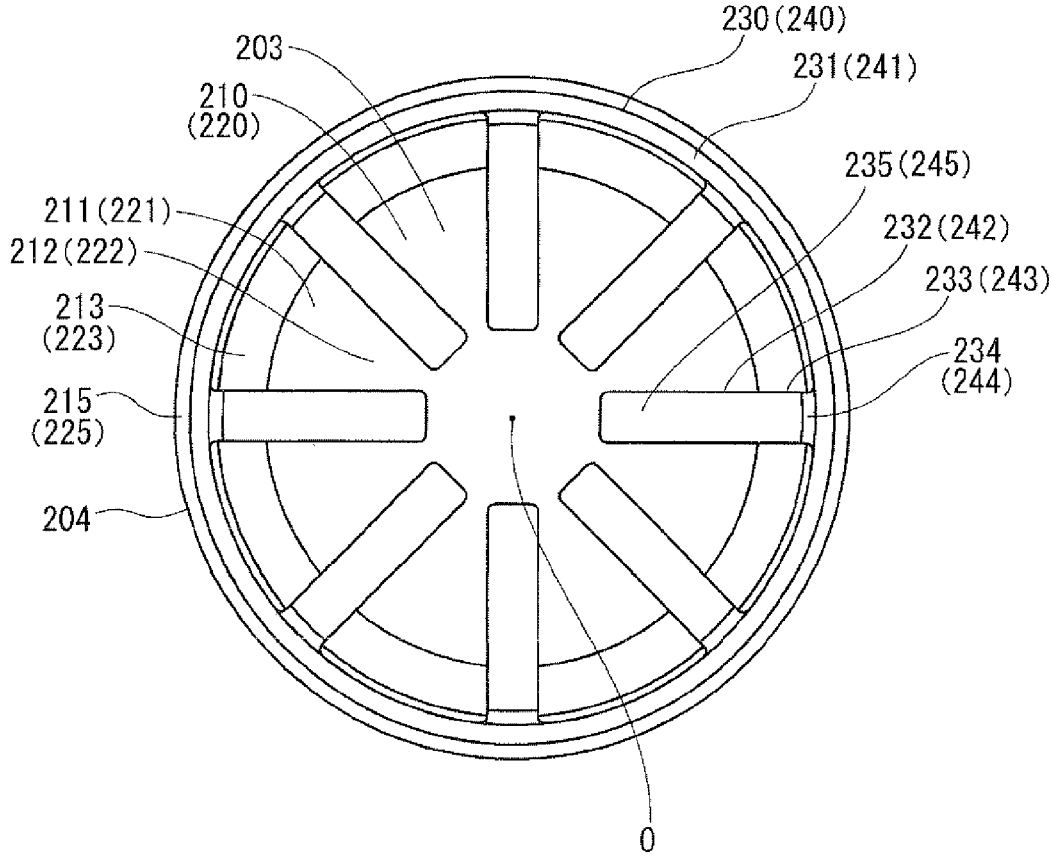
FIG. 1B is a plan view taken in a direction of an arrow IB in FIG. 1A, showing a first-side cover member and a damper member.

The first-side diaphragm 210 includes a first-side concave portion 211 and a first-side outer peripheral portion 215. The first-side concave portion 211 is resiliently deformable. The first-side outer peripheral portion 215 is configured into an annular thin plate form and extends along an outer peripheral edge of the first-side concave portion 211. The first-side concave portion 211 and the first-side outer peripheral portion 215 are integrally formed as a single continuous element. As shown in FIGS. 1A and 1B, the first-side concave portion 211 is configured into the dish form and includes a generally circular disk region and a curved region. The curved region is located radially outward of the generally circular disk region. The generally circular disk region is hereinafter referred to as a circular disk section 212, and the curved region is hereinafter referred to as a curved section 213.

The second-side diaphragm 220 is configured into a similar form, which is similar to the first-side diaphragm 210, and thereby the second-side diaphragm 220 includes a second-side concave portion 221 and a second-side outer peripheral portion 225. The generally circular disk region of the second-side concave portion 221 is hereinafter referred to as a circular disk section 222, and the curved section of the second-side concave portion 221 is hereinafter referred to as a curved section 223.

The damper member 203 is assembled as follows. That is, the first-side diaphragm 210 and the second-side diaphragm 220 are held together such that the concave surface of the first-side diaphragm 210 and the concave surface of the second-side diaphragm 220 are opposed to each other, and the first-side outer peripheral portion 215 and the second-side outer peripheral portion 225 are joined together. An outer peripheral edge part of the first-side outer peripheral portion 215 and an outer peripheral edge part of the second-side outer peripheral portion 225 are welded together along the entire circumference thereof and thereby form a weld 204 (joint portion). In this way, a sealed damper chamber 205 is formed between the first-side diaphragm 210 and the second-side diaphragm 220. The damper chamber 205 is filled with a gas (such as helium, argon or a mixture of helium and argon) at a predetermined pressure, which is equal to or higher than the atmospheric pressure. The first-side diaphragm 210 and the second-side diaphragm 220 are resiliently deformable depending on a change in the pressure of the fuel chamber 16. When the first-side diaphragm 210 and the second-side diaphragm 220 are resiliently deformed by the pressure of the fuel chamber 16, a relative positional change occurs between a center of the circular disk section 212 and a center of the circular disk section 222. Thereby, the volume of the damper chamber 205 is changed to reduce the pressure pulsation of the fuel, which flows through the fuel chamber 16. The circular disk section 212 and the circular disk section 222 serve as movable portions. The curved section 213 and the curved section 223 serve as non-movable portions (stationary portions).

The first-side diaphragm 210 is configured as follows. That is, one end surface of the first-side outer peripheral portion 215, which is opposite from the second-side diaphragm 220, extends in an imaginary plane S shown FIG. 1. This imaginary plane S is spaced by a predetermined distance d from one end surface of the circular disk section 212, which is opposite from the second-side diaphragm 220, in a direction perpendicular to the imaginary plane S. Specifically, when the pressure outside of the damper member 203 (more specifically, outside of the damper chamber 205) and the pressure inside of the damper member 203 (more specifically, inside of the damper chamber 205) are substantially equal to each other, the center of the end surface of the circular disk section 212, which is opposite from the second-side diaphragm 220, is spaced by the distance d from the imaginary plane S in the direction perpendicular to the imaginary plate S. Similarly, the second-side diaphragm 220 is configured as follows. That is, one end surface of the second-side outer peripheral portion 225, which is opposite from the first-side diaphragm 210, extends in an imaginary plane. This imaginary plane is spaced by a predetermined distance, which is substantially the same as the predetermined distance d, from one end surface of the circular disk section 222, which is opposite from the first-side diaphragm 210, in a direction perpendicular to the imaginary plane.

A spring constant of the first-side diaphragm 210 and of the second-side diaphragm 220 is set depending on the required durability or any other required performance of the damper member 203 by appropriately selecting a wall thickness and a material of the first and second-side diaphragms 210, 220 and the pressure of the gas filled in the damper chamber 205. A frequency of the pressure pulsation to be reduced by the damper member 203 is determined according to this spring constant. Furthermore, the pressure pulsation reducing performance (pressure pulsation damping performance) of the damper member 203 varies depending on the volume of the damper chamber 205 (the diameter of the circular disk section 212 and of the circular disk section 222 and the distance d).

Figure 3A:
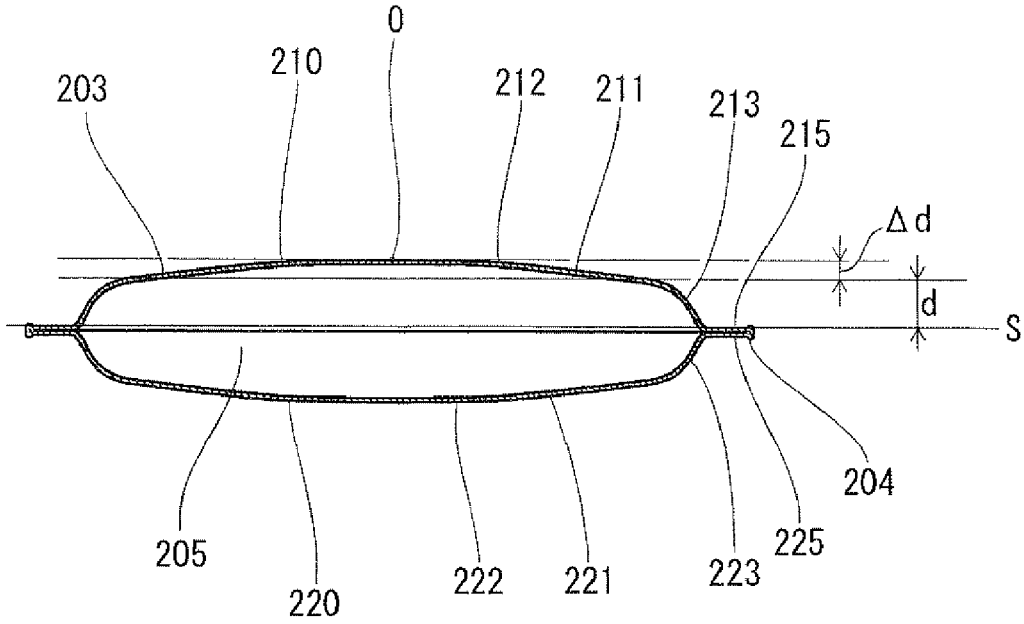
FIG. 3A is a cross-sectional view of the damper member of the high pressure pump of the first embodiment.
Figure 3B:
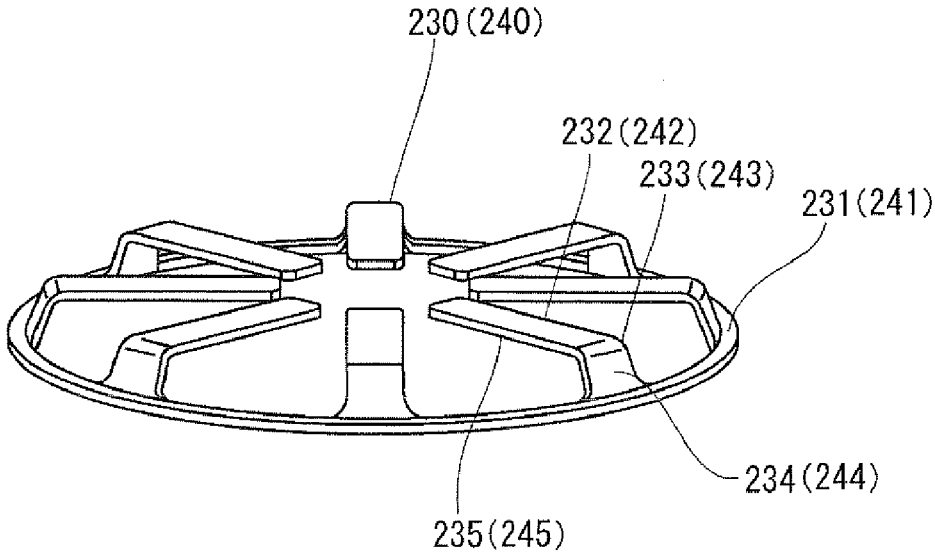
FIG. 3B is a perspective view showing the first-side cover member of the first embodiment.

The first-side cover member 230 and the second-side cover member 240 are formed by processing a sheet of metal, such as stainless steel having a predetermined rigidity through press working process or bending process. As shown in FIGS. 1A, 1B and 3B, the first-side cover member 230 includes a first-side outer peripheral portion 231 and a first-side limiting portion 232. The first-side outer peripheral portion 231 is configured into a generally annular form, and the first-side limiting portion 232 radially inwardly extends from the first-side outer peripheral portion 231. In the present embodiment, the first-side limiting portion 232 includes a plurality of arms 233, which radially inwardly extend from the first-side outer peripheral portion 231. Each arm 233 includes a support section 234 and an engaging section 235. The support section 234 extends from an inner peripheral edge part of the first-side outer peripheral portion 231 such that the support section 234 is bent on one end surface side of the first-side outer peripheral portion 231, which is opposite from the second-side cover member 240. The engaging section 235 radially inwardly extends from a distal end of the support section 234, which is opposite from the first-side outer peripheral portion 231, such that the engaging section 235 is generally in parallel with the first-side outer peripheral portion 231.

The shape of the second-side cover member 240 is the same as that of the first-side cover member 230. In FIGS. 1B and 3B, the components of the second-side cover member 240 and the components of the second-side diaphragm 220 are indicated with the corresponding parenthesized numerals. The second-side cover member 240 includes a second-side outer peripheral portion 241 and a second-side limiting portion 242. The second-side outer peripheral portion 241 is configured into a generally annular form, and the second-side limiting portion 242 radially inwardly extends from the second-side outer peripheral portion 241. The second-side limiting portion 242 includes a plurality of arms 243, which radially inwardly extend from the second-side outer peripheral portion 241. Each arm 243 includes a support section 244 and an engaging section 245. The support section 244 extends from an inner peripheral edge part of the second-side outer peripheral portion 241 such that the support section 244 is bent on one end surface side of the second-side outer peripheral portion 241, which is opposite from the first-side cover member 230. The engaging section 245 radially inwardly extends from a distal end of the support section 244, which is opposite from the second-side outer peripheral portion 241, such that the engaging section 245 is generally in parallel with the second-side outer peripheral portion 241.

When the first-side cover member 230 is assembled and is installed in place as the component of the damper device 200, the first-side outer peripheral portion 231 of the first-side cover member 230 is engaged with the first-side outer peripheral portion 215 of the first-side diaphragm 210. Similarly, when the second-side cover member 240 is assembled and is installed in place as the component of the damper device 200, the second-side outer peripheral portion 241 of the second-side cover member 240 is engaged with the second-side outer peripheral portion 225 of the second-side diaphragm 220. The outer diameter of the first-side cover member 230 and of the second-side cover member 240 is smaller than the outer diameter of the damper member 203. Therefore, the first-side outer peripheral portion 231 and the second-side outer peripheral portion 241 can be engaged with the first-side outer peripheral portion 215 and the second-side outer peripheral portion 225, respectively, at a corresponding radial location, which is radially inward of the weld 204 to avoid the direct contact with weld 204. Thereby, it is possible to reduce a possibility of occurrence of damage to the weld 204, which would be caused by the engagement of the weld 204 with the first-side outer peripheral portion 231 and the second-side outer peripheral portion 241.

One side (one end surface) of the first-side limiting portion 232 of the first-side cover member 230 and one side (one end surface) of the second-side limiting portion 242 of the second-side cover member 240, which are adjacent to the damper member 203, are coated with fluoroplastic.

The first-side cover member 230 is configured as follows. That is, one end surface of the first-side outer peripheral portion 231, which is adjacent to the first-side diaphragm 210, extends in the imaginary plane S shown FIG. 1. This imaginary plane S is spaced by the predetermined distance d from one end surface of the engaging section 235, which is adjacent to the first-side diaphragm 210, in the direction perpendicular to the imaginary plane S. Specifically, when the pressure outside of the damper member 203 (more specifically, outside of the damper chamber 205) and the pressure inside of the damper member 203 (more specifically, inside of the damper chamber 205) are substantially equal to each other, the end surface of the circular disk section 212, which is opposite from the second-side diaphragm 220, is spaced by the distance d from the imaginary plane S in the direction perpendicular to the imaginary plate S, and also the end surface of the engaging section 235, which is adjacent to the first-side diaphragm 210, is spaced by the distance d from the imaginary plane S in the direction perpendicular to the imaginary plane S. The engaging sections 245 of the second-side cover member 240 are configured in a manner similar to that of the engaging sections 235 of the first-side cover member 230.

As shown in FIG. 1A, the first-side support member 250 and the second-side support member 260 clamp the damper member 203, the first-side cover member 230 and the second-side cover member 240 therebetween to support them in the fuel chamber 16. The first-side support member 250 is placed between the first-side cover member 230 and the opening cover member 12 to urge the first-side outer peripheral portion 231 of the first-side cover member 230 against the first-side outer peripheral portion 215 of the first-side diaphragm 210. The second-side support member 260 is placed between the second-side cover member 240 and the damper housing 201 to urge the second-side outer peripheral portion 241 of the second-side cover member 240 against the second-side outer peripheral portion 225 of the second-side diaphragm 220, so that the first-side outer peripheral portion 231, the first-side outer peripheral portion 215, the second-side outer peripheral portion 225 and the second-side outer peripheral portion 241 are clamped between the first-side support member 250 and the second-side support member 260.

Specifically, the first-side support member 250 is formed into a generally cylindrical tubular form from metal, such as stainless steel. The first-side support member 250 includes a small diameter tubular portion 251 and a large diameter tubular portion 252. The small diameter tubular portion 251 is configured into a generally cylindrical tubular form. The large diameter tubular portion 252 is located on one side of the small diameter tubular portion 251, which is opposite from the opening cover member 12. The large diameter tubular portion 252 is also configured into a generally cylindrical tubular form and has an inner diameter, which is larger than that of the small diameter tubular portion 251. Because of the inner diameter difference between the small diameter tubular portion 251 and the large diameter tubular portion 252, a stepped surface is formed between the small diameter tubular portion 251 and the large diameter tubular portion 252. The small diameter tubular portion 251 has a projection 253, which is configured into a generally annular form and projects from the stepped surface on one side of the small diameter tubular portion 251, which is opposite from the opening cover member 12. The projection 253 is engageable with the first-side outer peripheral portion 231 of the first-side cover member 230. A Belleville spring (serving as a resilient member) 254 is placed between the first-side support member 250 and the opening cover member 12. In this way, the projection 253 of the first-side support member 250 urges the first-side outer peripheral portion 231 against the first-side outer peripheral portion 215. The large diameter tubular portion 252 has the inner diameter, which is larger than the outer diameter of the damper member 203, so that the damper member 203 is placed radially inward of the large diameter tubular portion 252. In this way, radial displacement of the damper member 203 can be limited.

The second-side support member 260 is formed by, for example, processing a sheet of metal, such as stainless steel, into a generally cylindrical tubular form through press working process or bending process. One end part of the second-side support member 260 is engaged with the damper housing 201, and the other end part of the second-side support member 260 is engaged with the second-side outer peripheral portion 241 of the second-side cover member 240. In this way, the other end part of the second-side support member 260 urges the second-side outer peripheral portion 241 against the second-side outer peripheral portion 225.

With the above-described construction, the first-side support member 250 and the second-side support member 260 clamp the damper member 203, the first-side cover member 230 and the second-side cover member 240 therebetween to support them in the fuel chamber 16.

The second-side support member 260 has through holes 261, which radially connect between the outer wall and the inner wall of the second-side support member 260 and are arranged one after another in the circumferential direction. In this way, the fuel in the fuel chamber 16 can flow between the outer space, which is located radially outward of the second-side support member 260, and the inner space, which is located radially inward of the second-side support member 260, i.e., is located on the second-side cover member 240 side of the damper member 203. The Belleville spring 254 is placed between the first-side support member 250 and the opening cover member 12. Therefore, the fuel in the fuel chamber 16 can flow between the outer space, which is located radially outward of the first-side support member 250, and the inner space, which is located radially inward of the first-side support member 250, i.e., is located on the first-side cover member 230 side of the damper member 203 through gaps between the Belleville spring 254 and the first-side support member 250 and gaps between the Belleville spring 254 and the opening cover member 12. With this construction, when the fuel chamber 16 is filled with the fuel, the damper member 203 receives the pressure of the fuel in the fuel chamber 16 from both of the first-side cover member 230 side of the damper member 203 and the second-side cover member 240 side of the damper member 203.

Next, the manufacturing procedure of the high pressure pump 10, particularly the manufacturing procedure of the damper device 200 will be described. This manufacturing procedure involves the following processes.

First of all, a damper member manufacturing process will be described. In the damper member manufacturing process, the first-side diaphragm 210 and the second-side diaphragm 220 are held together in a welding chamber of a welding machine (not shown) such that the concave surface of the first-side diaphragm 210 and the concave surface of the second-side diaphragm 220 are opposed to each other, and the first-side outer peripheral portion 215 and the second-side outer peripheral portion 225 contact with each other. Then, the gas (such as helium, argon or the mixture of helium and argon) is supplied into the welding chamber, and the pressure in the welding chamber is set to the predetermined pressure, which is equal to or higher than the atmospheric pressure. Also, this predetermined pressure is lower than a lower limit value of a predetermined pressure range, within which the pressure of the fuel chamber 16 changes during the operation of the high pressure pump 10. At this time, the predetermined pressure may be set to, for example, several hundred MPa. Thereafter, the outer peripheral edge part of the first-side outer peripheral portion 215 and the outer peripheral edge part of the second-side outer peripheral portion 225 are welded together along the entire circumference thereof. In this way, the sealed damper chamber 205 is formed between the first-side diaphragm 210 and the second-side diaphragm 220.

The gas of the predetermined pressure, which is discussed above, is sealed in the damper chamber 205 of the damper member 203, which is manufactured through the above-described process. Therefore, the damper member 203 is placed in a bulged state (the state where the center of the circular disk section 212 and the center of the circular disk section 222 are spaced from each other) in the atmosphere (see FIG. 3A). Thereby, a stress is generated at or around a boundary between the circular disk section 212 and the curved section 213 as well as a boundary between the circular disk section 222 and the curved section 223. At this time, the distance between the center O of the end surface of the circular disk section 212, which is opposite from the second-side diaphragm 220, and the imaginary plane S is expressed as the distance d+Δd (see FIG. 3A).

Next, an assembling process will be described. In the assembling process, the damper member 203, which is manufactured in the damper member manufacturing process, is installed in the interior of the damper housing 201 along with the other components. Specifically, the second-side support member 260, the second-side cover member 240, the damper member 203, the first-side cover member 230, the first-side support member 250 and the Belleville spring 254 are installed into the interior of the damper housing 201 in this order. Then, the opening 202 of the damper housing 201 is closed with the opening cover member 12, and the inner wall of the opening cover member 12 and the outer wall of the damper housing 201 are welded together. In this way, as shown in FIG. 1A, in the interior of the fuel chamber 16, the damper housing 201 and the second-side support member 260 contact, i.e., engage with each other, and the second-side support member 260 and the second-side outer peripheral portion 241 contact with each other. Also, the second-side outer peripheral portion 241 and the second-side outer peripheral portion 225 contact with each other, and the first-side outer peripheral portion 215 and the first-side outer peripheral portion 231 contact with each other. Furthermore, the first-side outer peripheral portion 231 and the projection 253 contact with each other, and the small diameter tubular portion 251 and the Belleville spring 254 contact with each other. In addition, the Belleville spring 254 and the opening cover member 12 contact with each other. At this time, the first-side outer peripheral portion 231, the first-side outer peripheral portion 215, the second-side outer peripheral portion 225 and the second-side outer peripheral portion 241 are engaged one after another and are clamped between the first-side support member 250 and the second-side support member 260 by the resilient force (urging force) of the Belleville spring 254.

The damper device 200, which is formed through the assembling process, limits the bulging of the damper member 203 through the engagement of the engaging sections 235 of the first-side limiting portion 232 against the circular disk section 212 of the first-side concave portion 211 and also through the engagement of the engaging sections 245 of the second-side limiting portion 242 against the circular disk section 222 of the second-side concave portion 221. In this way, the distance between the center O of the end surface of the circular disk section 212, which is opposite from the second-side diaphragm 220, and the imaginary plane S is limited to the distance d. Therefore, at this time, after the damper member manufacturing process, the stress, which is generated at or around the boundary between the circular disk section 212 and the curved section 213, and the stress, which is generated at or around the boundary between the circular disk section 222 and the curved section 223, become substantially zero (0).

Next, the operation of the high pressure pump 10 will be described.

First of all, an intake stroke will be described. When the plunger 13 is moved downward in FIG. 2, the energization of the coil 71 is stopped. Therefore, the valve member 35 is urged toward the pressurizing chamber 121 by the needle 38, which is integral with the movable core 73 that receives the force from the spring 22. Thereby, the valve member 35 is lifted away from the valve seat 34 of the valve body 30. Furthermore, when the plunger 13 is moved downward in FIG. 2, the pressure of the pressurizing chamber 121 is decreased. As a result, the force, which is applied to the valve member 35 from the fuel on one side of the valve member 35 opposite from the pressurizing chamber 121, becomes larger than the force, which is applied to the valve member 35 from the fuel on the other side of the valve member 35 where the pressurizing chamber 121 is located. Thereby, the force is applied to the valve member 35 in the direction away from the valve seat 34, so that the valve member 35 is lifted away from the valve seat 34. The valve member 35 is moved until the guide portion 37 engages the stepped surface 501 of the stopper 40. When the valve member 35 is lifted away from the valve seat 34, when the valve member 35 is placed in a valve open state, fuel in the fuel chamber 16 is drawn into the pressurizing chamber 121 through the guide passage 111, the passage 151, the annular fuel passage 101, the passage 102 and the intake passage 112 in this order. Furthermore, at this time, the fuel in the fuel passage 102 can flow into the volume chamber 41 through the conduit 42. Therefore, the pressure of the volume chamber 41 becomes equal to the pressure of the fuel passage 102.

Next, a metering stroke will be described. When the plunger 13 is driven from the bottom dead center toward the top dead center, the flow of fuel, which is discharged from the pressurizing chamber 121 toward the fuel chamber 16, results in application of the force of fuel, which is located on the pressurizing chamber 121 side of the valve member 35, against the valve member 35 toward the valve seat 34. However, when the coil 71 is not energized, the needle 38 is urged toward the valve member 35 by the urging force of the spring 22. Therefore, the movement of the valve member 35 toward the valve seat 34 is limited by the needle 38. Furthermore, the pressurizing chamber 121 side wall surface of the valve member 35 is covered with the stopper 40. In this way, the direct application of the dynamic pressure, which is generated by the flow of fuel discharged from the pressurizing chamber 121 toward the fuel chamber 16, on the valve member 35 is limited. Therefore, the force, which is applied by the flow of fuel against the valve member 35 in the valve closing direction, is alleviated.

In the metering stroke, while the energization of the coil 71 is stopped, the valve member 35 is held in the state where the valve member 35 is lifted away from the valve seat 34 and is engaged with the stepped surface 501. Thereby, the low pressure fuel, which is discharged from the pressurizing chamber 121 due to the upward movement of the plunger 13, is returned to the fuel chamber 16 by flowing in the opposite direction that is opposite from the direction in the case of drawing fuel from the fuel chamber 16 to the pressurizing chamber 121, i.e., by flowing through the intake passage 112, the fuel passage 102, the annular fuel passage 101, the passage 151 and the guide passage 111 in this order.

When the coil 71 is energized in the middle of the metering stroke, a magnetic field is generated by the coil 71 to form a magnetic circuit in the stator core 72, the flange 75 and the movable core 73. In this way, the magnetic attractive force is generated between the stator core 72 and the movable core 73, which have been spaced from each other before the energization of the coil 71. When the magnetic attractive force, which is generated between the stator core 72 and the movable core 73, is increased beyond the urging force of the spring 22, the movable core 73 is moved toward the stator core 72. Thereby, the needle 38, which is integrated with the movable core 73, is also moved toward the stator core 72. When the needle 38 is moved toward the stator core 72, the valve member 35 and the needle 38 are spaced from each other. Therefore, the valve member 35 does not receive the force from the needle 38. Thus, the valve member 35 is moved toward the valve seat 34 by the urging force of the spring 21 and the force applied to the valve member 35 in the valve closing direction by the flow of the low pressure fuel discharged from the pressurizing chamber 121 toward the fuel chamber 16. In this way, the valve member 35 is seated against the valve seat 34.

When the valve member 35 is moved toward and is seated against the valve seat 34, the valve member 35 is placed in the valve closed state. Thereby, the flow of the fuel through the fuel passage 100 is blocked. In this way, the metering stroke for discharging the low pressure fuel from the pressurizing chamber 121 to the fuel chamber 16 is terminated. At the time of upwardly moving the plunger 13, the communication between the pressurizing chamber 121 and the fuel chamber 16 is closed, and thereby the quantity of low pressure fuel, which is returned from the pressurizing chamber 121 to the fuel chamber 16, is adjusted. Therefore, the quantity of fuel, which is pressurized in the pressurizing chamber 121, is determined.

Now, a pressurizing stroke will be described. In the closed state where the communication between the pressurizing chamber 121 and the fuel chamber 16 is closed, when the plunger 13 is further upwardly moved toward the top dead center, the pressure of the fuel in the pressurizing chamber 121 is further increased. When the pressure of the fuel in the pressurizing chamber 121 becomes equal to or larger than a predetermined pressure, the check valve 92 is lifted away from the valve seat 95 against the urging force of the spring 94 of the delivery valve arrangement 90 and the force applied to the check valve 92 from the fuel on the downstream side of the valve seat 95. In this way, the delivery vale arrangement 90 is opened. Thereby, the fuel, which is pressurized in the pressurizing chamber 121, is discharged from the high pressure pump 10 through the delivery passage 114. The fuel, which is discharged from the high pressure pump 10, is supplied to and accumulated in a delivery pipe (not shown), from which the high pressure fuel is supplied to the injectors.

When the plunger 13 reaches the top dead center, the energization of the coil 71 is stopped. Thereby, the valve member 35 is lifted away from the valve seat 34 once again. At this time, the plunger 13 is downwardly moved in FIG. 2 once again, so that the pressure of the fuel in the pressurizing chamber 121 is reduced. In this way, the fuel is drawn into the pressurizing chamber 121 from the fuel chamber 16.

Here, it should be noted that the energization of the coil 71 may be stopped when the pressure of the fuel in the pressurizing chamber 121 is increased to the predetermined value upon the closing the valve member 35. When the pressure of the fuel in the pressurizing chamber 121 becomes large, the force, which is applied from the fuel in the pressurizing chamber 121 to the valve member 35 toward the valve seat 34, becomes larger than the force, which is applied to the valve member 35 in the direction away from the valve seat 34. Therefore, even when the energization of the coil 71 is stopped, the valve member 35 is held in the seated state where the valve member 35 is seated against the valve seat 34 by the force of the fuel applied from the pressurizing chamber 121 to the valve member 35. As discussed above, when the energization of the coil 71 is stopped at the predetermined timing, it is possible to reduce the electric power consumption of the electromagnetic drive device 70.

When the intake stroke, the metering stroke and the pressurizing stroke are repeated, the fuel, which is drawn into the high pressure pump 10, is pressurized and is discharged from the high pressure pump 10. The quantity of the fuel, which is discharged from the high pressure pump 10, is adjusted by controlling the timing of the energization of the coil 71 of the electromagnetic drive device 70.

Next, the stress, which is generated in the damper member 203 at the time of operating the high pressure pump 10, will be discussed.

Figure 4:
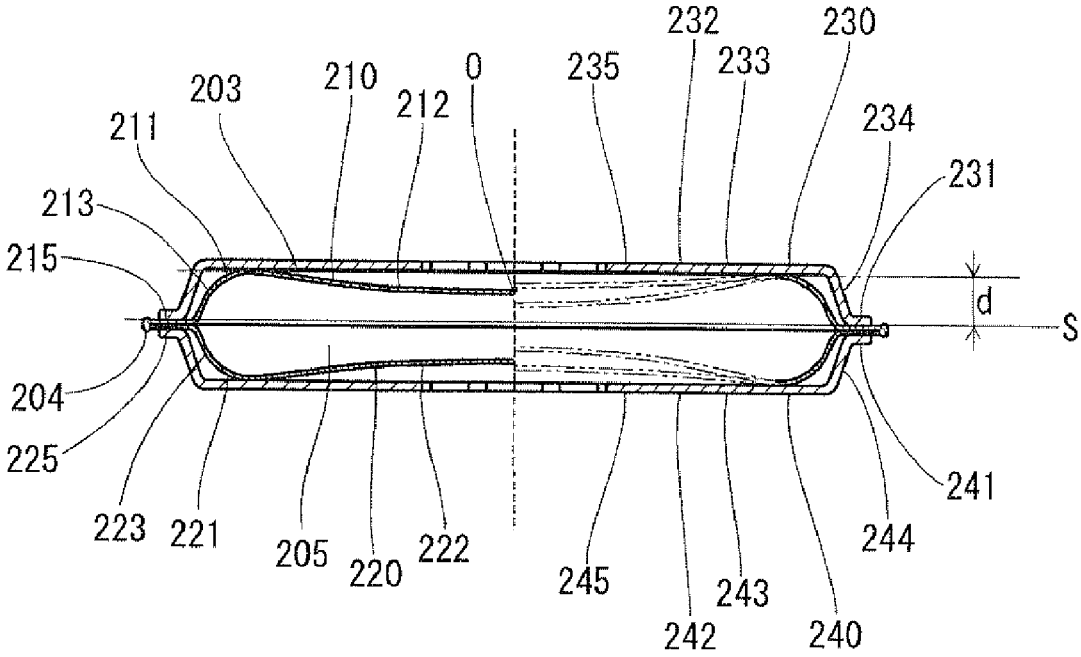
FIG. 4 is a schematic cross-sectional view showing the first-side cover member, a second-side cover member and the damper member of the high pressure pump according to the first embodiment.

In FIG. 4, a left half of the damper member 203, which is located on a left side of a dotted line in FIG. 4, shows the state of the damper member 203 while the fuel chamber 16 is placed in the operation start time state, in which fuel is supplied into the fuel chamber 16 immediately after starting of the operation of the high pressure pump 10. In contrast, a right half of the damper member 203 of FIG. 4, which is located on a right side of the dotted line in FIG. 4, shows the state of the damper member 203 while the fuel chamber 16 is placed in the operating state, in which the pressure of the fuel in the fuel chamber 16 is changing in the middle of the operation of the high pressure pump 10. In the case of the present embodiment, with reference to FIG. 4, it should be understood that the center of the first-side concave portion 211 and the center of the second-side concave portion 221 are spaced away from the first-side limiting portion 232 and the second-side limiting portion 242, respectively, in both of the operation start time state and the operating state of the fuel chamber 16.

Figure 5A:
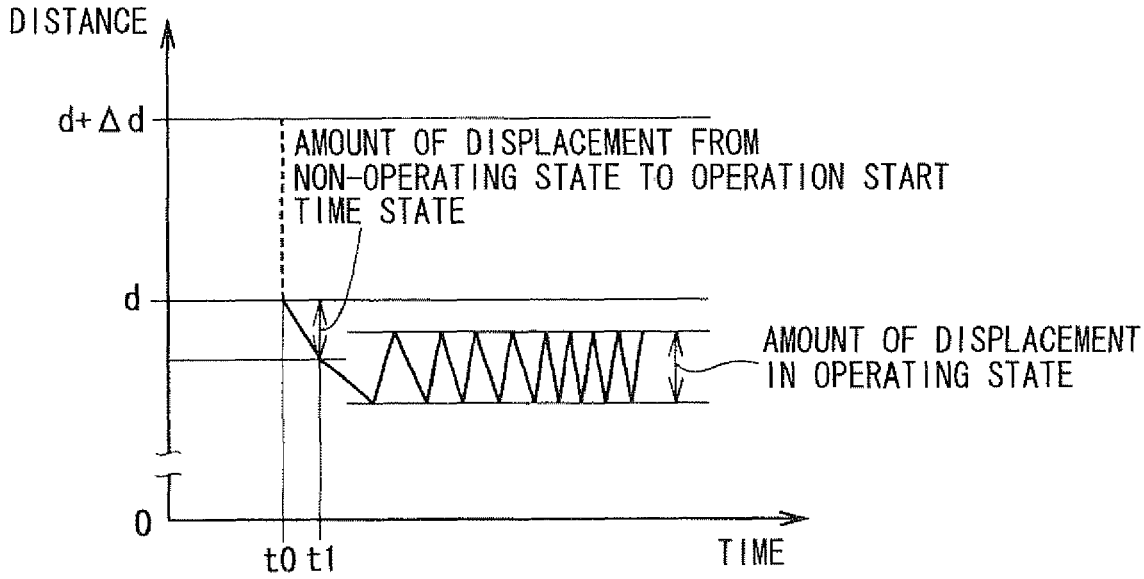
FIG. 5A is a diagram showing displacement of the first-side diaphragm of the high pressure pump with time according to the first embodiment.

FIG. 5A shows a change in the distance between the center O of the end surface of the circular disk section 212 of the first-side diaphragm 210, which is opposite from the second-side diaphragm 220, and the imaginary plane S since the time to, at which the high pressure pump 10 is not operated because of, for example, stopping of the engine of the vehicle, i.e., at which the fuel chamber 16 is in the non-operating state. In the non-operating state of the fuel chamber 16, the pressure of the fuel chamber 16 is substantially the same as the atmospheric pressure. Therefore, for instance, in a case of a damper device, which does not have the first-side cover member 230, the damper member 203 is placed in the bulged state, and thereby the distance between the center O and the imaginary plane S becomes d+Δd. In contrast, according to the present embodiment, in the non-operating state of the fuel chamber 16, the bulging of the damper member 203 is limited by the first-side limiting portion 232. Therefore, according to the present embodiment, at the time t0, the distance between the center O and the imaginary plane S becomes d. When the state of the fuel chamber 16 is changed from the non-operating state (time t0) to the operation start time state (time t1), the center O is displaced due to the deformation of the circular disk section 212. Therefore, the distance between the center O and the imaginary plane S is reduced. When the state of the fuel chamber 16 is further changed from the operation start time state (time t1), i.e., when the fuel chamber 16 is placed in the operating state, the deformation of the circular disk section 212 is repeated. Therefore, the center O is repeatedly moved toward and away from the imaginary plane S.

Figure 5B:
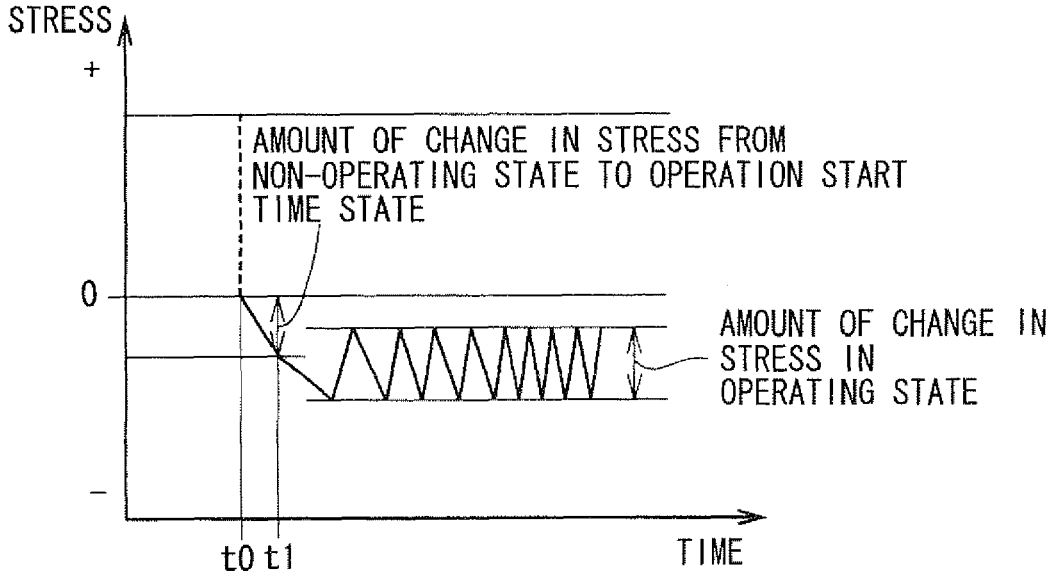
FIG. 5B is a diagram showing a stress generated in the first-side diaphragm of the high pressure pump with time according to the first embodiment.

FIG. 5B shows a change in the stress (for the descriptive purpose, this stress will be referred to as a stress generated in the damper member 203) at or around the boundary between the circular disk section 212 and the curved section 213 at the time of occurrence of the change in the distance between the center O and the imaginary plane S in a manner shown in FIG. 5A. In FIG. 5B, the positive (+) side of the axis of ordinates indicates the stress generated in the damper member 203 in the state where the damper member 203 is in the bulged state, i.e., in the state where the distance between the center O and the imaginary plane S is larger than the distance d. In contrast, in FIG. 5B, the negative (−) side of the axis of the ordinates indicates the stress generated in the damper member 203 in the state where the distance between the center O and the imaginary plane S is smaller than the distance d. In the present embodiment, when the fuel chamber 16 is in the non-operating state, the bulging of the damper member 203 is limited by the first-side limiting portion 232. Therefore, at this time (time to), the stress generated in the damper member 203 is zero (0).

Next, there will be described differences between the damper device 200 of the present embodiment and the damper device (comparative example that is not shown), which does not have the first-side cover member 230.

Figure 6A:
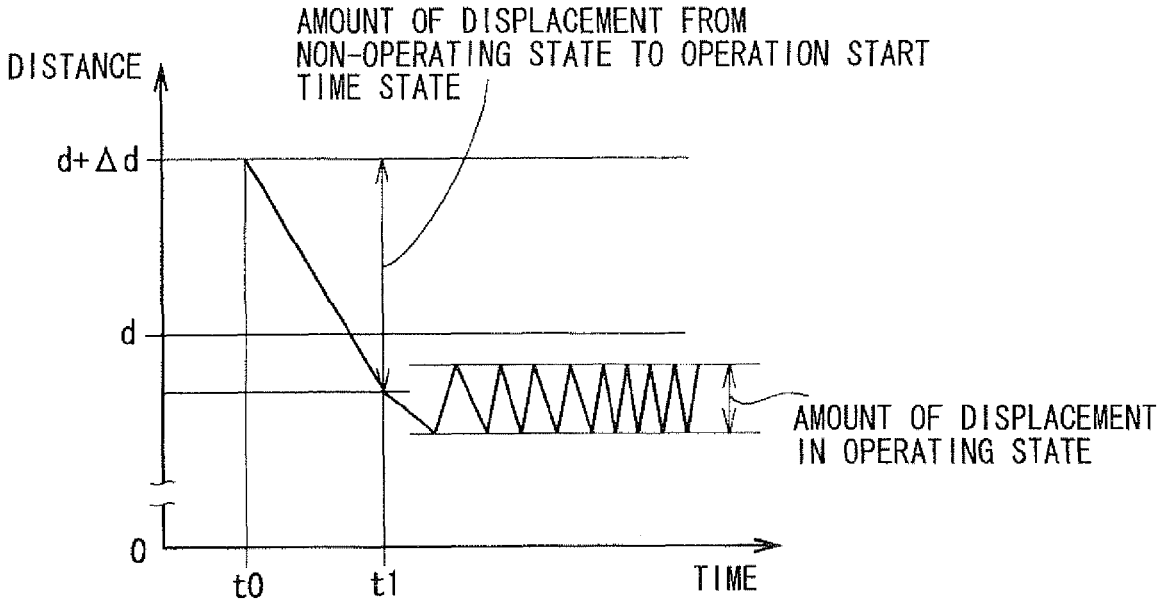
FIG. 6A RELATED ART
FIG. 6A is a diagram showing displacement of a first-side diaphragm of a high pressure pump of a comparative example with time.
Figure 6B:
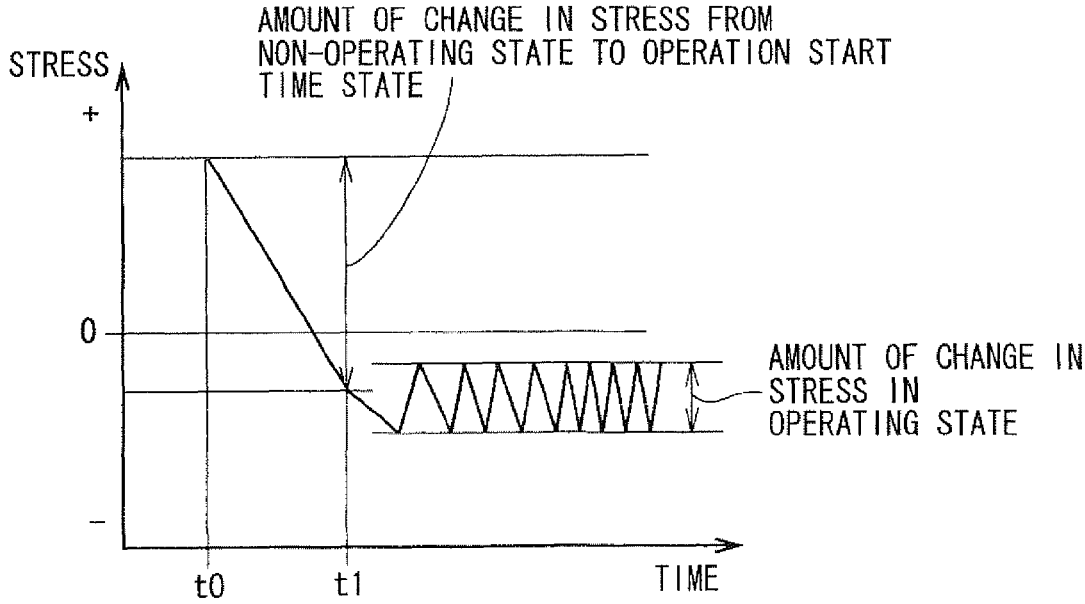
FIG. 6B RELATED ART
FIG. 6B is a diagram showing a stress generated in the first-side diaphragm of the high pressure pump of the comparative example with time.

FIG. 6A shows a change in the distance between the center O and the imaginary plane S in the case of the damper device of the comparative example. FIG. 6B shows a change in the stress generated in the damper device of the comparative example in the case where the distance between the center O and the imaginary plane S changes in a manner shown in FIG. 6A. As shown in FIG. 6A, in the damper device of the comparative example, when the fuel chamber 16 is in the non-operating state (time t0), the distance between the center O and the imaginary plane S is d+Δd. Therefore, the amount of displacement of the center O at the time of changing the state of the fuel chamber 16 from the non-operating state (time t0) to the operation start time state (time t1) becomes large, and thereby the amount of change in the stress (stress amplitude) generated in the damper member becomes also large (see FIG. 6B).

When FIG. 5A and FIG. 6A are compared with each other, it is understood that the amount of displacement of the center O of the damper device 200 of the present embodiment at the time of changing the state of the fuel chamber 16 from the non-operating state to the operation start time state is smaller than that of the damper device of the comparative example by the amount Δd. When FIG. 5B and FIG. 6B are compared with each other, it is understood that the amount of change in the stress generated in the damper member 203 of the damper device 200 of the present embodiment at the time of changing the state of the fuel chamber 16 from the non-operating state to the operation start time state is smaller than that of the damper device of the comparative example.

As discussed above, in the high pressure pump 10 of the present embodiment, the damper chamber 205 of the damper member 203 is filled with the gas of the predetermined pressure, which is equal to or higher than the atmospheric pressure but is lower than the lower limit value of the predetermined pressure range, within which the pressure of the fuel chamber 16 changes during the operation (operating state) of the high pressure pump 10. Furthermore, the first-side limiting portion 232 of the first-side cover member 230 and the second-side limiting portion 242 of the second-side cover member 240 are constructed such that the first-side limiting portion 232 and the second-side limiting portion 242 are engaged with the first-side concave portion 211 of the first-side diaphragm 210 and the second-side concave portion 221 of the second-side diaphragm 220, respectively, to limit the bulging of the damper member 203 when the pressure of the fuel chamber 16 is equal to or less than the predetermined pressure. In this way, when the state of the fuel chamber 16 is changed from the non-operating state to the operation start time state, the amount of the displacement of the circular disk sections 212, 222 (movable portions) of the first and second-side diaphragms 210, 220 can be made small. Thus, the amount of change in the stress generated in the first and second-side diaphragms 210, 220 can be reduced. As a result, the lifetime of the damper member 203 can be lengthened. Thereby, the lifetime of the damper device 200 can be lengthened.

Furthermore, the first-side limiting portion 232 of the first-side cover member 230 and the second-side limiting portion 242 of the second-side cover member 240 are constructed such that the first-side limiting portion 232 and the second-side limiting portion 242 are spaced away from the center of the first-side concave portion 211 of the first-side diaphragm 210 and the center of the second-side concave portion 221 of the second-side diaphragm 220, respectively, when the pressure of the fuel chamber 16 is changed within the predetermined pressure range. Specifically, when the pressure of the fuel chamber 16 is changed within the predetermined pressure range to cause the repeated displacement of the circular disk sections 212, 222 (movable portions), the center of the first-side concave portion 211 and the center of the second-side concave portion 221 do not engage the first-side limiting portion 232 and the second-side limiting portion 242, respectively. In this way, it is possible to limit the wearing caused by the engagement of the first and second-side concave portions 211, 221 with the first and second-side limiting portions 232, 242, respectively. The one side of the first-side limiting portion 232 of the first-side cover member 230 and the one side of the second-side limiting portion 242 of the second-side cover member 240, which are adjacent to the damper member 203, are coated with fluoroplastic. In this way, it is possible to limit the wearing caused by the engagement of the first and second-side limiting portions 232, 242 with the damper member 203. Thus, the lifetime of the damper member 203 can be kept lengthened.

(Second Embodiment)

Figure 7:
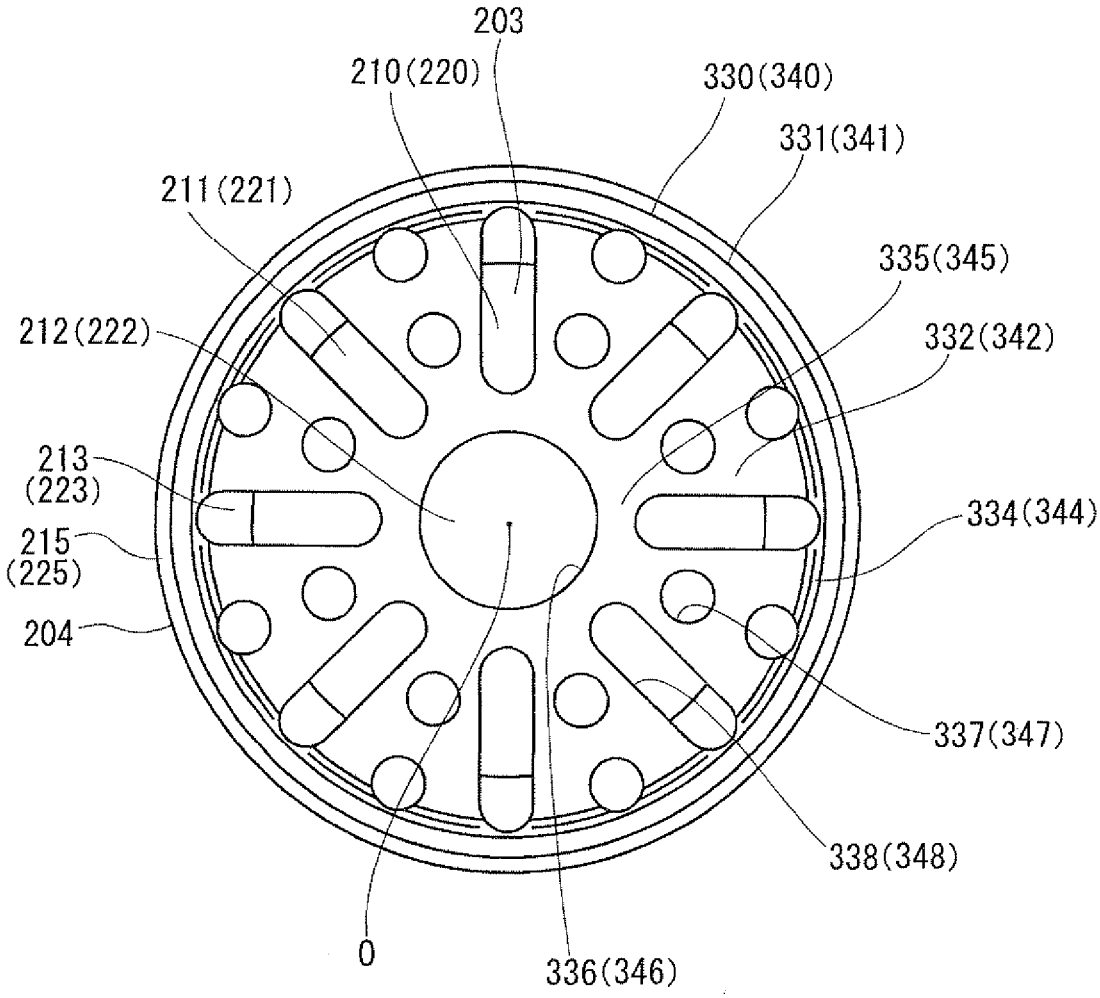
FIG. 7 is a plan view showing a portion of a damper device of a high pressure pump according to a second embodiment of the present invention.

FIG. 7 shows a portion of a high pressure pump according to a second embodiment of the present invention. In the second embodiment, the shapes of the first and second-side cover members 330, 340 are different from those of the first embodiment.

In the second embodiment, the first-side cover member 330 is formed by processing a sheet of metal, such as stainless steel having a predetermined rigidity through press working process or bending process. The first-side cover member 330 includes a first-side outer peripheral portion 331 and a first-side limiting portion 332. The first-side outer peripheral portion 331 is configured into a generally annular form, and the first-side limiting portion 332 radially inwardly extends from the first-side outer peripheral portion 331. In the present embodiment, the first-side limiting portion 332 is configured to radially inwardly extend from the first-side outer peripheral portion 331 and to cover the first-side concave portion 211 of the first-side diaphragm 210. That is, the first-side limiting portion 332 is configured to correspond with the shape of the first-side concave portion 211 and is thereby have a dish form. The first-side limiting portion 332 includes a support section 334 and an engaging section 335. The support section 334 is configured into a cylindrical tubular form and extends from an inner peripheral edge part of the first-side outer peripheral portion 331 on one side of the first-side outer peripheral portion 331. The engaging section 335 is configured into a generally planar form and radially inwardly extends from an end part of the support section 334, which is opposite from the first-side outer peripheral portion 331, such that the engaging section 335 is generally parallel with the first-side outer peripheral portion 331. The first-side limiting portion 332 includes a large hole 336, small holes 337 and elongated holes 338, all of which are formed as through holes to communicate between one side of the first-side limiting portion 332 where the first-side concave portion 211 is located and the other side of the first-side limiting portion 332 opposite from the first-side concave portion 211. In this way, the fuel, which is located on the one side of the first-side cover member 330 opposite from the damper member 203, can flow toward the damper member 203 side through the large hole 336, the small holes 337 and the elongated holes 338.

The shape of the second-side cover member 340 of the second embodiment is the same as that of the first-side cover member 330. In FIG. 7, the components of the second-side cover member 340 and the components of the second-side diaphragm 220 are indicated with the corresponding parenthesized numerals. The second-side cover member 340 includes a second-side outer peripheral portion 341 and a second-side limiting portion 342, which are similar to the first-side outer peripheral portion 331 and the first-side limiting portion 331, respectively. The second-side limiting portion 342 includes a support section 344 and an engaging section 345, which are similar to the support section 334 and the engaging section 335, respectively, of the first-side limiting portion 332. The second-side limiting portion 342 includes a large hole 346, small holes 347 and elongated holes 348, which are similar to the large hole 336, the small holes 337 and the elongated holes 338, respectively, of the first-side limiting portion 332. Since the shape of the second-side cover member 340 is the same as the shape of the first-side cover member 330, detailed description of the second-side cover member 340 is omitted for the sake of simplicity.

Even in the second embodiment, the damper chamber 205 of the damper member 203 is filled with the gas of the predetermined pressure, which is equal to or higher than the atmospheric pressure but is lower than the lower limit value of the predetermined pressure range, within which the pressure of the fuel chamber 16 changes during the operation (operating state) of the high pressure pump 10. Furthermore, the first-side limiting portion 332 of the first-side cover member 330 and the second-side limiting portion 342 of the second-side cover member 340 are constructed such that the first-side limiting portion 332 and the second-side limiting portion 342 are engaged with the first-side concave portion 211 of the first-side diaphragm 210 and the second-side concave portion 221 of the second-side diaphragm 220, respectively, to limit the bulging of the damper member 203 when the pressure of the fuel chamber 16 is equal to or less than the predetermined pressure. In this way, similar to the first embodiment, the lifetime of the damper member 203 can be lengthened. Thereby, the lifetime of the damper device 200 can be lengthened.

Furthermore, the first-side limiting portion 332 of the first-side cover member 330 and the second-side limiting portion 342 of the second-side cover member 340 are constructed such that the first-side limiting portion 332 and the second-side limiting portion 342 are spaced away from the center of the first-side concave portion 211 of the first-side diaphragm 210 and the center of the second-side concave portion 221 of the second-side diaphragm 220, respectively, when the pressure of the fuel chamber 16 is changed within the predetermined pressure range. In this way, similar to the first embodiment, it is possible to limit the wearing caused by the engagement of the first and second-side concave portions 211, 221 with the corresponding one of the first and second-side limiting portions 332, 342, respectively. One side of the first-side limiting portion 332 of the first-side cover member 330 and one side of the second-side limiting portion 342 of the second-side cover member 340, which are adjacent to the damper member 203, are coated with fluoroplastic. In this way, it is possible to limit the wearing caused by the engagement of the first and second-side limiting portions 332, 342 with the damper member 203. Thus, the lifetime of the damper member 203 can be kept lengthened.

(Third Embodiment)

Figure 8A:
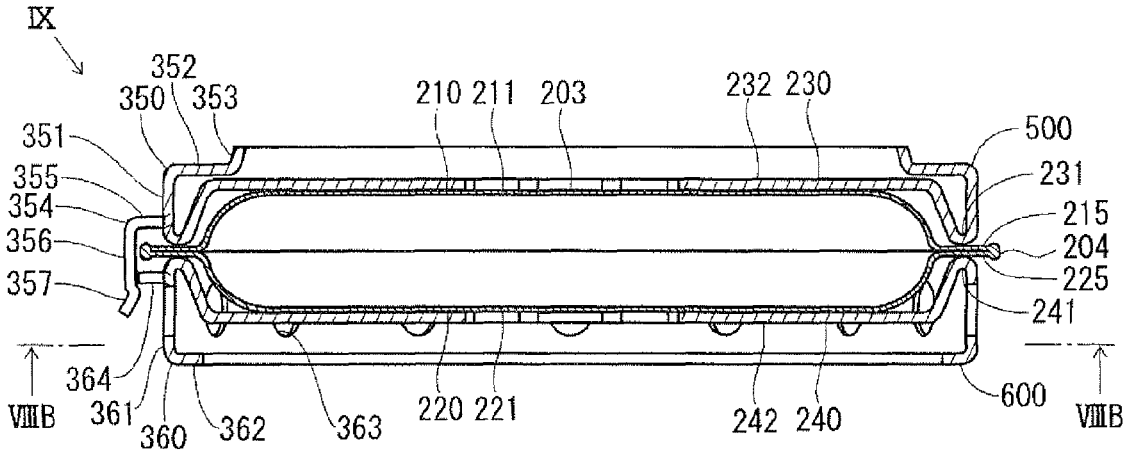
FIG. 8A is cross-sectional view taken along line VIIIA-VIIIA in FIG. 8B, showing a portion of a high pressure pump according to a third embodiment of the present invention.
Figure 8B:
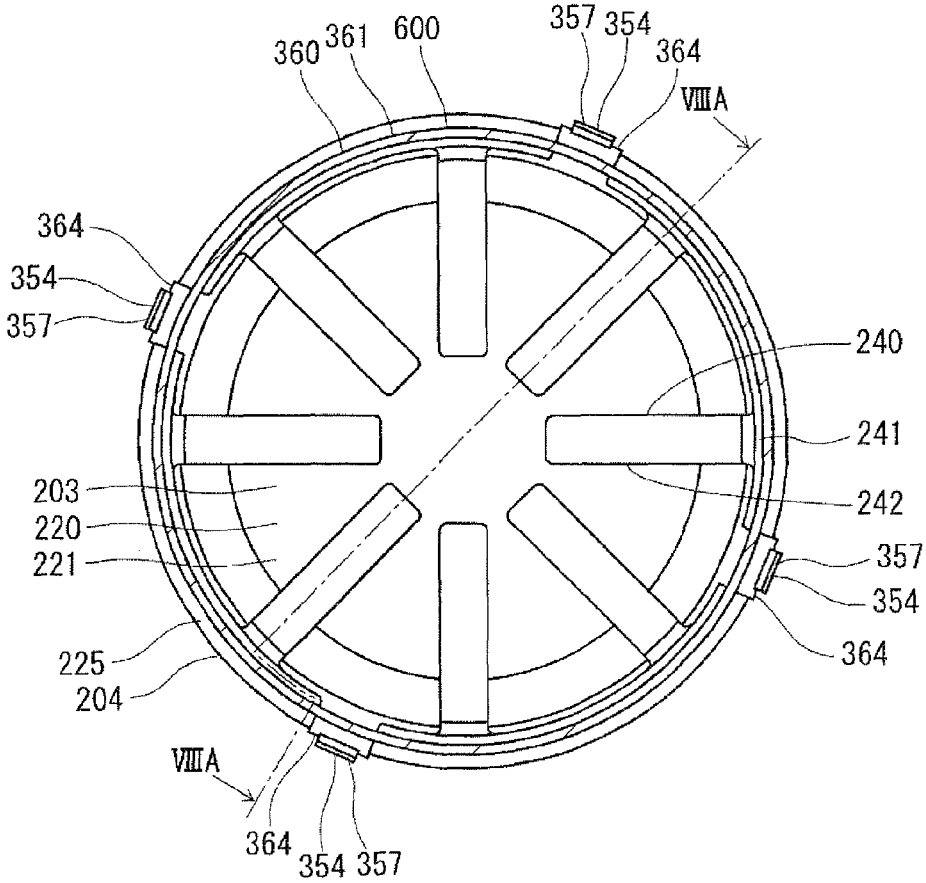
FIG. 8B is a cross-sectional view taken along line VIIIB-VIIIB in FIG. 8A.

FIGS. 8A and 8B show a portion of a high pressure pump according to a third embodiment of the present invention. In the third embodiment, the shapes of the first and second-side support members are different from those of the first embodiment.

As shown in FIG. 8A, the first-side support member 350 includes a tubular portion 351, a top surface portion 352 and a small diameter tubular portion 353. The tubular portion 351 is configured into a generally cylindrical tubular form. The top surface portion 352 is configured into a generally annular form and radially inwardly extends from one end part of the tubular portion 351. The small diameter tubular portion 353 is configured into a generally cylindrical tubular form and extends from an inner peripheral edge part of the top surface portion 352 in a direction opposite from the tubular portion 351. As discussed above, the first-side support member 350 is configured into the generally cylindrical tubular form.

Furthermore, the first-side support member 350 includes first-side engaging portions 354, which project radially outward from the tubular portion 351. Each first-side engaging portion 354 includes an extending section 355, an embracing section 356 and a clip claw section 357. The extending section 355 radially outwardly extends from the tubular portion 351. The embracing section 356 is bent from a distal end part of the extending section 355 and extends generally parallel with the central axis of the tubular portion 351. The clip claw section 357 is radially inwardly bent once in the radial direction of the tubular portion 351 and then radially outwardly bent at its distal end part. In the present embodiment, the number of the first-side engaging portions 354 is four, and these four first-side engaging portions 354 are arranged one after another at generally equal intervals in the circumferential direction of the tubular portion 351 (see FIG. 8B).

Furthermore, in the present embodiment, the first-side cover member 230 and the first-side support member 350 are integrally formed such that the first-side outer peripheral portion 231 of the first-side cover member 230 and the end part of the tubular portion 351, which is opposite from the top surface portion 352, are joined together. Specifically, the first-side cover member 230 and the first-side support member 350 are formed as a single member (single component). Here, the member, in which the first-side cover member 230 and the first-side support member 350 are integrated together, is referred to as a first-side body 500. The first-side body 500 is formed by, for example, processing a sheet of metal, such as stainless steel, into the corresponding shape discussed above.

The second-side support member 360 includes a tubular portion 361 and a bottom surface portion 362. The tubular portion 361 is configured into a generally cylindrical tubular form. The tubular portion 361 has through holes 363, which radially connect between the outer wall and the inner wall of the tubular portion 361 and are arranged one after another in the circumferential direction. The through holes 363 have a function, which is similar to that of the through holes 261 of the first embodiment. The bottom surface portion 362 is configured into a generally annular form and radially inwardly extends from one end part of the tubular portion 361. As discussed above, the second-side support member 360 is configured into the generally cylindrical tubular form.

Furthermore, the second-side support member 360 includes second-side engaging portions 364, which project radially outward from the tubular portion 361. The second-side engaging portions 364 are arranged such that the circumferential location of each of the second-side engaging portions 364 coincides with, i.e., is aligned with the circumferential location of the corresponding one of the first-side engaging portions 354 when the first-side support member 350 is placed coaxially with the second-side support member 360. In the present embodiment, similar to the first-side engaging portions 354, the number of the second-side engaging portions 364 is four (see FIG. 8B).

Furthermore, in the present embodiment, the second-side cover member 240 and the second-side support member 360 are integrally formed such that the second-side outer peripheral portion 241 of the second-side cover member 240 and the end part of the tubular portion 361, which is opposite from the bottom surface portion 362, are joined together. Specifically, the second-side cover member 240 and the second-side support member 360 are formed as a single member (single component). Here, the member, in which the second-side cover member 240 and the second-side support member 360 are integrated together, is referred to as a second-side body 600. The second-side body 600 is formed by, for example, processing a sheet of metal, such as stainless steel, into the corresponding shape discussed above.

In the present embodiment, the first-side support member 350 and the second-side support member 360 hold the damper member 203 through the first-side cover member 230 and the second-side cover member 240 when the first-side engaging portions 354 and the second-side engaging portions 364 are engaged with each other. Specifically, the first-side body 500 and the second-side body 600 are engaged with each other while the damper member 203 is clamped between the first-side body 500 and the second-side body 600, so that the damper member 203 is held by the first-side body 500 and the second-side body 600.

Now, the engagement between the first-side engaging portions 354 and the second-side engaging portions 364 will be described in detail.

A distance between a radially inner wall surface of one of the embracing sections 356 and a radially inner wall surface of a diametrically opposed one of the embracing sections 356, which is diametrically opposed to, i.e., circumferentially displaced 180 degrees from the above one of the embracing sections 356 is set to be larger than the outer diameter of the damper member 203. Furthermore, a distance between a radially inner wall surface of one of the clip claw sections 357 and a radially inner wall surface of a diametrically opposed one of the clip claw sections 357, which is diametrically opposed to the above one of the clip claw sections 357, is set to be slightly smaller than a distance between a radially outer wall surface of one of the second-side engaging portions 364 and a radially outer wall surface of a diametrically opposed one of the second-side engaging portions 364, which is diametrically opposed to the above one of the second-side engaging portions 364. Thereby, in the state where the first-side engaging portions 354 and the second-side engaging portions 364 are engaged with each other, the clip claw sections 357 are engaged with, i.e., are press fitted to the second-side engaging portions 364, respectively.

Next, an assembling process for assembling the first-side body 500, the second-side body 600 and the damper member 203 will be described.

This assembling process is executed after the damper member manufacturing process. In this assembling process, the second-side support member 360 is placed first, and then the damper member 203 is placed over the second-side support member 360. Then, each of the first-side engaging portions 354 is aligned with the corresponding one of the second-side engaging portions 364, and the first-side support member 350 is placed over the damper member 203. In this way, each of the clip claw sections 357 contacts the corresponding one of the second-side engaging portions 364.

Figure 9:
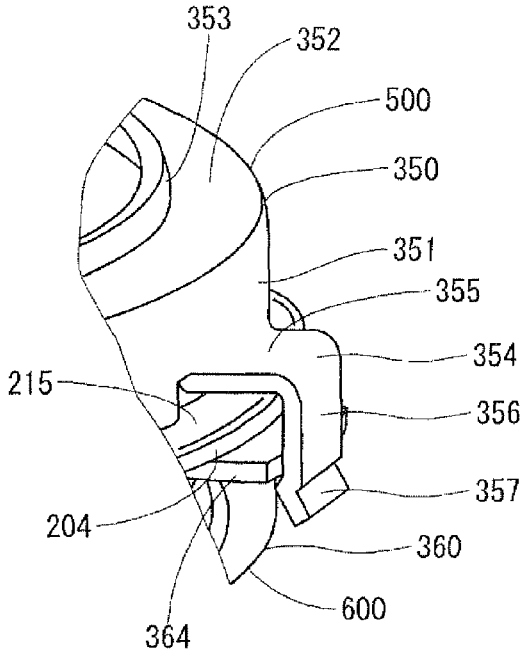
FIG. 9 is a partial perspective view taken in a direction of an arrow IX in FIG. 8A.

In the contact state where each of the clip claw sections 357 contacts the corresponding one of the second-side engaging portions 364, when the first-side support member 350 is urged downward, the first-side engaging portions 354 are resiliently radially outwardly deformed to place the clip claw sections 357 radially outward of the second-side engaging portions 364 and are then radially inwardly returned to engage with the second-side engaging portions 364 (thereby implementing the snap fit engagement between each one of the first-side engaging portions 354 and the corresponding one of the second-side engaging portions 364). The assembled members (the first-side body 500, the second-side body 600), which are assembled together through the above-described engagement (see FIGS. 8A to 9), will not be easily separated from each other during the time of further processing the assembled members, the time of storing the assembled members or the time of transporting the assembled members.

In this way, the assembling of the first-side body 500, the second-side body 600 and the damper member 203 is completed, so that the first-side body 500, the second-side body 600 and the damper member 203 are integrated as a subassembly (i.e., being placed in a subassembly state).

In the subassembly state, the first-side limiting portion 232 is engaged with the first-side concave portion 211, and the second-side limiting portion 242 is engaged with the second-side concave portion 221, so that the bulging of the damper member 203 is limited (see FIG. 8A). That is, desirably, the level of the engaging force between the first-side engaging portions 354 and the second-side engaging portions 364, i.e., the level of the force, which limits the separation between the first-side engaging portions 354 and the second-side engaging portions 364, is set to one that can limit the bulging of the damper member 203 by the first-side limiting portion 232 and the second side limiting portion 242.

Next, the installation of the first-side body 500, the second-side body 600 and the damper member 203, which are held in the subassembly state, into the interior of the damper housing 201 will be described.

Figure 10:
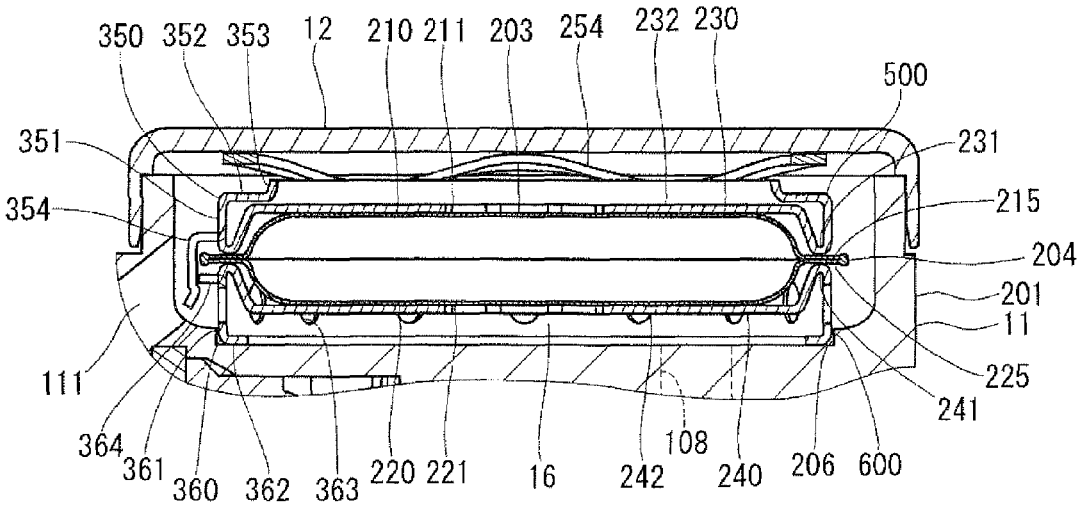
FIG. 10 is a cross-sectional view showing a damper device of a high pressure pump according to a third embodiment of the present invention.

As shown in FIG. 10, a stepped portion (blind hole, i.e., recess) 206 is formed in the bottom portion of the damper housing 201 and is configured into a generally annular form. A diameter of the stepped portion 206 is set to be generally the same as the outer diameter of the tubular portion 361 of the second-side support member 360. The tubular portion 361 is aligned to the stepped portion 206, and the first-side body 500, the second-side body 600 and the damper member 203, which are integrated into the subassembly state, are installed into the interior of the damper housing 201. Thereby, the tubular portion 361 is fitted to the stepped portion 206. In this way, the second-side support member 360 is position in place, and the radial displacement of the second-side support member 360 is limited upon the installation thereof. Furthermore, at this time, the bottom surface portion 362 of the second-side support member 360 is engaged with the bottom portion (inner bottom surface, i.e., inner base surface) of the damper housing 201.

The Belleville spring 254 is placed between the first-side support member 350 and the opening cover member 12. The Belleville spring 254 urges the top surface portion 352 of the first-side support member 350 toward the bottom portion side of the housing 201. The urging force of the Belleville spring 254, which urges the top surface portion 352, is conducted to the bottom portion of the damper housing 201 through the first-side body 500, the damper member 203 and the bottom surface portion 362 of the second-side body 600. In this way, positions of the first-side body 500, the second-side body 600 and the damper member 203, which are integrated into the subassembly state, are stabilized in the fuel chamber 16. The inner peripheral edge part of the Belleville spring 254 is guided by the small diameter tubular portion 353 of the first-side support member 350.

As discussed above, according to the present embodiment, the first-side cover member 230 and the first-side support member 350 are integrated such that the first-side outer peripheral portion 231 of the first-side cover member 230 and the end part of the first-side support member 350, which is adjacent to the first-side cover member 230, are joined together (the first-side body 500). Furthermore, the second-side cover member 240 and the second-side support member 360 are integrally formed such that the second-side outer peripheral portion 241 of the second-side cover member 240 and the end part of the second-side support member 360, which is adjacent to the second-side cover member 240, are joined together (the second-side body 600). Therefore, it is possible to reduce the number of the components of the damper device. Thereby, the manufacturing costs of the damper device can be reduced.

Furthermore, in the present embodiment, the first-side support member 350 includes the multiple first-side engaging portions 354, which radially outwardly project. The second-side support member 360 includes the second-side engaging portions 364, which are positioned to correspond with the first-side engaging portions 354, respectively, and radially outwardly project. The firsts-side support member 350 and the second-side support member 360 hold the damper member 203 through the first-side cover member 230 and the second-side cover member 240 when the first-side engaging portions 354 and the second-side engaging portions 364 are engaged with each other. Thus, according to the present embodiment, when the first-side engaging portions 354 and the second-side engaging portions 364 are engaged with each other, the first-side body 500 (the first-side support member 350, the first-side cover member 230), the second-side body 600 (the second-side support member 360, the second-side cover member 240) and the damper member 203 are assembled together and are thereby held in the subassembly state. In this way, the assembling of the damper device can be eased, and the manufacturing costs of the damper device can be reduced.

Furthermore, in the present embodiment, when the first-side limiting portion 232 and the second-side limiting portion 242 are engaged with the first-side concave portion 211 and the second-side concave portion 221, respectively, in the subassembly state, the bulging of the damper member 203 is limited. Therefore, when a time period from the time of completing the manufacturing of the damper member 203 and the time of forming the subassembly is reduced, it is possible to reduce a time period of exposing the damper member 203 under a free state (under the atmospheric pressure). In this way, it is possible to reduce the influences of the stress at the first-side diaphragm 210, the stress at the second-side diaphragm 220 and the stress at the joint portion (weld 204) between the first-side diaphragm 210 and the second-side diaphragm 220. Thus, the reliability of the joint portion between the first-side diaphragm 210 and the second-side diaphragm 220 can be improved, and the lifetime of the damper member 203 can be kept lengthened.

(Fourth Embodiment)

Figure 11:
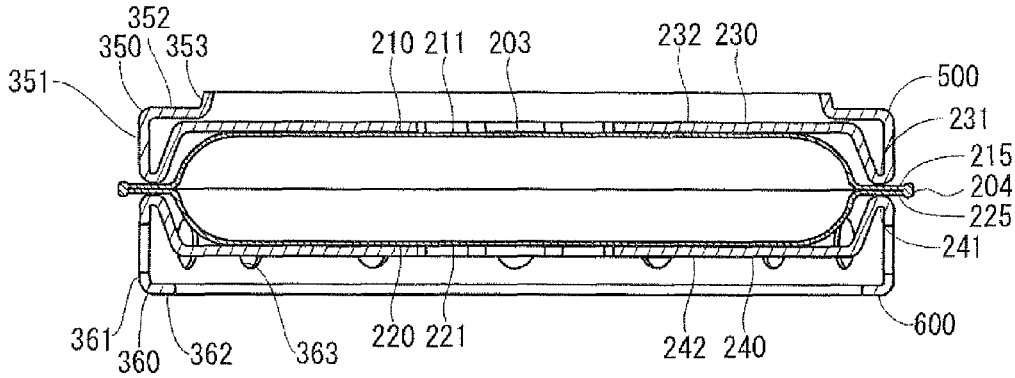
FIG. 11 is a cross-sectional view showing a portion of a damper device of a high pressure pump according to a fourth embodiment of the present invention.

FIG. 11 shows a portion of a high pressure pump according to a fourth embodiment of the present invention.

As shown in FIG. 11, in the fourth embodiment, the first-side support member 350 does not have the first-side engaging portions 354 (see FIG. 8A) discussed in the third embodiment. Furthermore, the second-side support member 360 does not have the second-side engaging portions (see FIG. 8A) discussed in the third embodiment. The damper device 200 of the fourth embodiment is substantially the same as the damper device 200 of the third embodiment except that the first-side engaging portions (354) and the second-side engaging portions (364) are not provided in the damper device 200 of the fourth embodiment.

In the fourth embodiment, unlike the third embodiment, the first-side body 500, the second-side body 600 and the damper member 203 cannot be assembled together as the subassembly. However, the first-side support member 350 and the first-side cover member 230 are integrally formed (the first-side body 500), and the second-side support member 360 and the second-side cover member 240 are integrally formed (the second-side body 600). As a result, the number of components of the damper device 200 can be reduced. Thereby, the manufacturing costs of the damper device can be reduced.

(Fifth Embodiment)

Figure 12:
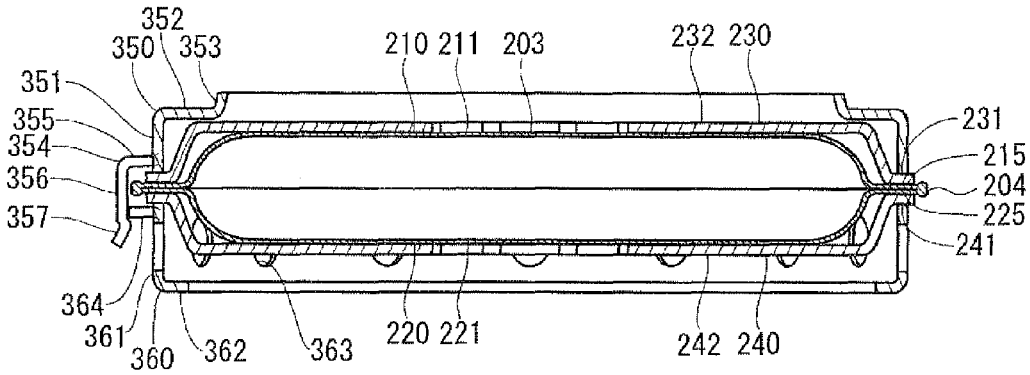
FIG. 12 is a cross-sectional view showing a portion of a damper device of a high pressure pump according to a fifth embodiment of the present invention.

FIG. 12 shows a portion of a high pressure pump according to a fifth embodiment of the present invention.

As shown in FIG. 12, in the fifth embodiment, the first-side support member 350 and the first-side cover member 230 are separately formed. Similarly, the second-side support member 360 and the second-side cover member 240 are separately formed. Other than the above discussed points, the damper device 200 of the fifth embodiment is the same as the damper device 200 of the third embodiment.

In the fifth embodiment, the firsts-side support member 350 and the second-side support member 360 hold the damper member 203 through the first-side cover member 230 and the second-side cover member 240 when the first-side engaging portions 354 and the second-side engaging portions 364 are engaged with each other. As discussed above, according to the present embodiment, when the first-side engaging portions 354 and the second-side engaging portions 364 are engaged with each other, the first-side support member 350, the first-side cover member 230, the second-side support member 360, the second-side cover member 240 and the damper member 203 are assembled together as the subassembly.

(Sixth Embodiment)

Figure 13:
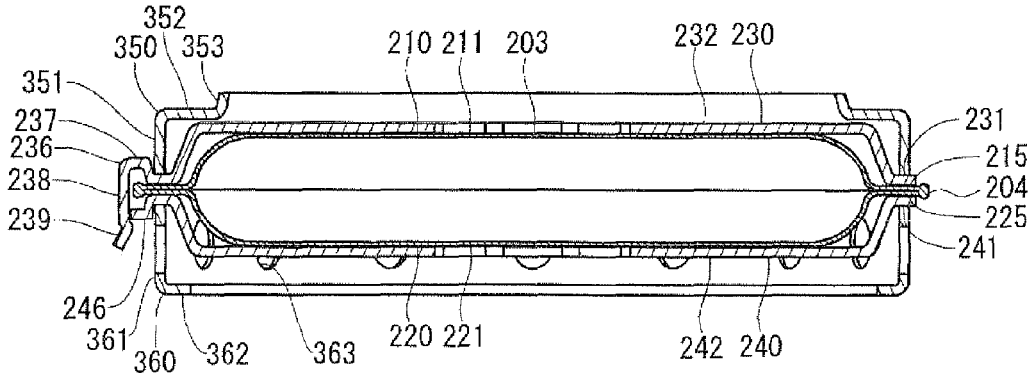
FIG. 13 is a cross-sectional view showing a portion of a damper device of a high pressure pump according to a sixth embodiment of the present invention.

FIG. 13 shows a portion of a high pressure pump according to a sixth embodiment of the present invention.

As shown in FIG. 13, in the sixth embodiment, the first-side support member 350 and the first-side cover member 230 are separately formed. Similarly, the second-side support member 360 and the second-side cover member 240 are separately formed.

Furthermore, in the present embodiment, the first-side cover member 230 includes first-side engaging portions 236, which radially outwardly project. Each first-side engaging portion 236 includes an extending section 237, an embracing section 238 and a clip claw section 239. The extending section 237 radially outwardly extends from the first-side outer peripheral portion 231. The embracing section 238 is bent from a distal end part of the extending section 237 and extends generally parallel with the central axis of the first-side cover member 230. The clip claw section 239 is radially inwardly bent once in the radial direction of the first-side cover member 230 and then radially outwardly bent at its distal end part. The extending section 237 extends from the outer peripheral edge part of the first-side outer peripheral portion 231 toward the first-side limiting portion 232 and then extends generally parallel to the plane of the first-side limiting portion 232 in the radially outward direction of the first-side outer peripheral portion 231. In the present embodiment, the number of the first-side engaging portions 236 is four, and these first-side engaging portions 236 are arranged one after another at generally equal intervals in the circumferential direction of the first-side outer peripheral portion 231.

The second-side cover member 240 includes second-side engaging portions 246, which radially outwardly project from the second-side outer peripheral portions 241. The second-side engaging portions 246 are arranged such that the circumferential location of each of the second-side engaging portions 246 coincides with, i.e., is aligned with the circumferential location of the corresponding one of the first-side engaging portions 236 when the first-side cover member 230 is placed coaxially with the second-side cover member 240. Each second-side engaging portion 246 extends from the outer peripheral edge part of the second-side outer peripheral portion 241 toward the second-side limiting portion 242 and then extends generally parallel to the plane of the second-side limiting portion 242 in the radially outward direction of the second-side outer peripheral portion 241. In the present embodiment, like the first-side engaging portions 236, the number of the second-side engaging portions 246 is four.

In the present embodiment, when the first-side engaging portions 236 and the second-side engaging portions 246 are engaged with each other, the first-side cover member 230 and the second-side cover member 240 hold the damper member 203 therebetween. Specifically, the first-side cover member 230 and the second-side cover member 240 are engaged with each other while the damper member 203 is clamped between the first-side cover member 230 and the second-side cover member 240, so that the damper member 203 is held by the first-side cover member 230 and the second-side cover member 240.

Now, the engagement between the first-side engaging portions 236 and the second-side engaging portions 246 will be described.

A distance between a radially inner wall surface of one of the embracing sections 238 and a radially inner wall surface of a diametrically opposed one of the embracing sections 238, which is diametrically opposed to the above one of the embracing sections 238, is set to be larger than the outer diameter of the damper member 203. Furthermore, a distance between a radially inner wall surface of one of the clip claw sections 239 and a radially inner wall surface of a diametrically opposed one of the clip claw sections 239, which is diametrically opposed to the above one of the clip claw sections 239, is set to be slightly smaller than a distance between a radially outer wall surface of one of the second-side engaging portions 246 and a radially outer wall surface of a diametrically opposed one of the second-side engaging portions 246, which is diametrically opposed to the above one of the second-side engaging portions 246. Thereby, in the state where the first-side engaging portions 236 and the second-side engaging portions 246 are engaged with each other, the clip claw sections 239 are engaged with the second-side engaging portions 246, respectively.

Next, an assembling process for assembling the first-side cover member 230, the second-side cover member 240 and the damper member 203 will be described.

This assembling process is executed after the damper member manufacturing process. In this assembling process, the second-side cover member 240 is placed first, and then the damper member 203 is placed over the second-side cover member 240. Then, each of the first-side engaging portions 236 is aligned with the corresponding one of the second-side engaging portions 246, and the first-side cover member 230 is placed over the damper member 203. In this way, each of the clip claw sections 239 contacts the corresponding one of the second-side engaging portions 246.

In the contact state where each of the clip claw sections 239 contacts the corresponding one of the second-side engaging portions 246, when the first-side cover member 230 is urged downward, the first-side engaging portions 236 are resiliently radially outwardly deformed to place the clip claw sections 239 radially outward of the second-side engaging portions 246 and are then radially inwardly returned to engage with the second-side engaging portions 246 (thereby implementing the snap fit engagement between each one of the first-side engaging portions 236 and the corresponding one of the second-side engaging portions 246). The assembled members (the first-side cover member 230 and the second-side cover member 240), which are assembled together through the above-described engagement (see FIG. 13), will not be easily separated from each other during the time of further processing the assembled members, the time of storing the assembled members or the time of transporting the assembled members.

In this way, the assembling of the first-side cover member 230, the second-side cover member 240 and the damper member 203 is completed, so that the first-side cover member 230, the second-side cover member 240 and the damper member 203 are integrated as a subassembly (i.e., being placed in a subassembly state).

In the subassembly state, the first-side limiting portion 232 is engaged with the first-side concave portion 211, and the second-side limiting portion 242 is engaged with the second-side concave portion 221, so that the bulging of the damper member 203 is limited (see FIG. 13). That is, desirably, the level of the engaging force between the first-side engaging portions 236 and the second-side engaging portions 246, i.e., the level of the force, which limits the separation between the first-side engaging portions 236 and the second-side engaging portions 246, is set to one that can limit the bulging of the damper member 203 by the first-side limiting portion 232 and the second-side limiting portion 242.

The first-side cover member 230, the second-side cover member 240 and the damper member 203, which are held together in the subassembly state, are placed into the interior of the damper housing 201 while the end part of the tubular portion 351 of the first-side support member 350 is engaged with the first-side outer peripheral portion 231 of the first-side cover member 230, and the end part of the tubular portion 361 of the second-side support member 360 is engaged with the second-side outer peripheral portion 241 of the second-side cover member 240.

As discussed above, in the present embodiment, the first-side cover member 230 includes the multiple first-side engaging portions 236, which radially outwardly project. The second-side cover member 240 includes the second-side engaging portions 246, which are positioned to correspond with the first-side engaging portions 236, respectively, and radially outwardly project. Furthermore, when the first-side engaging portions 236 and the second-side engaging portions 246 are engaged with each other, the first-side cover member 230 and the second-side cover member 240 hold the damper member 203 therebetween. Thereby, in the present embodiment, when the first-side engaging portions 236 are engaged with the second-side engaging portions 246, the first-side cover member 230, the second-side cover member 240 and the damper member 203 are held in the subassembly state. In this way, the assembling of the damper device can be eased, and the manufacturing costs of the damper device can be reduced.

Furthermore, in the present embodiment, when the first-side limiting portion 232 and the second-side limiting portion 242 are engaged with the first-side concave portion 211 and the second-side concave portion 221, respectively, in the subassembly state, the bulging of the damper member 203 is limited. Therefore, when a time period from the time of completing the manufacturing of the damper member 203 and the time of forming the subassembly is reduced, it is possible to reduce a time period of exposing the damper member 203 under a free state (under the atmospheric pressure). In this way, it is possible to reduce the influences of the stress at the first-side diaphragm 210, the stress at the second-side diaphragm 220 and the stress at the joint portion (weld 204) between the first-side diaphragm 210 and the second-side diaphragm 220. Thus, the reliability of the joint portion between the first-side diaphragm 210 and the second-side diaphragm 220 can be improved, and the lifetime of the damper member 203 can be kept lengthened.

(Seventh Embodiment)

Figure 14:
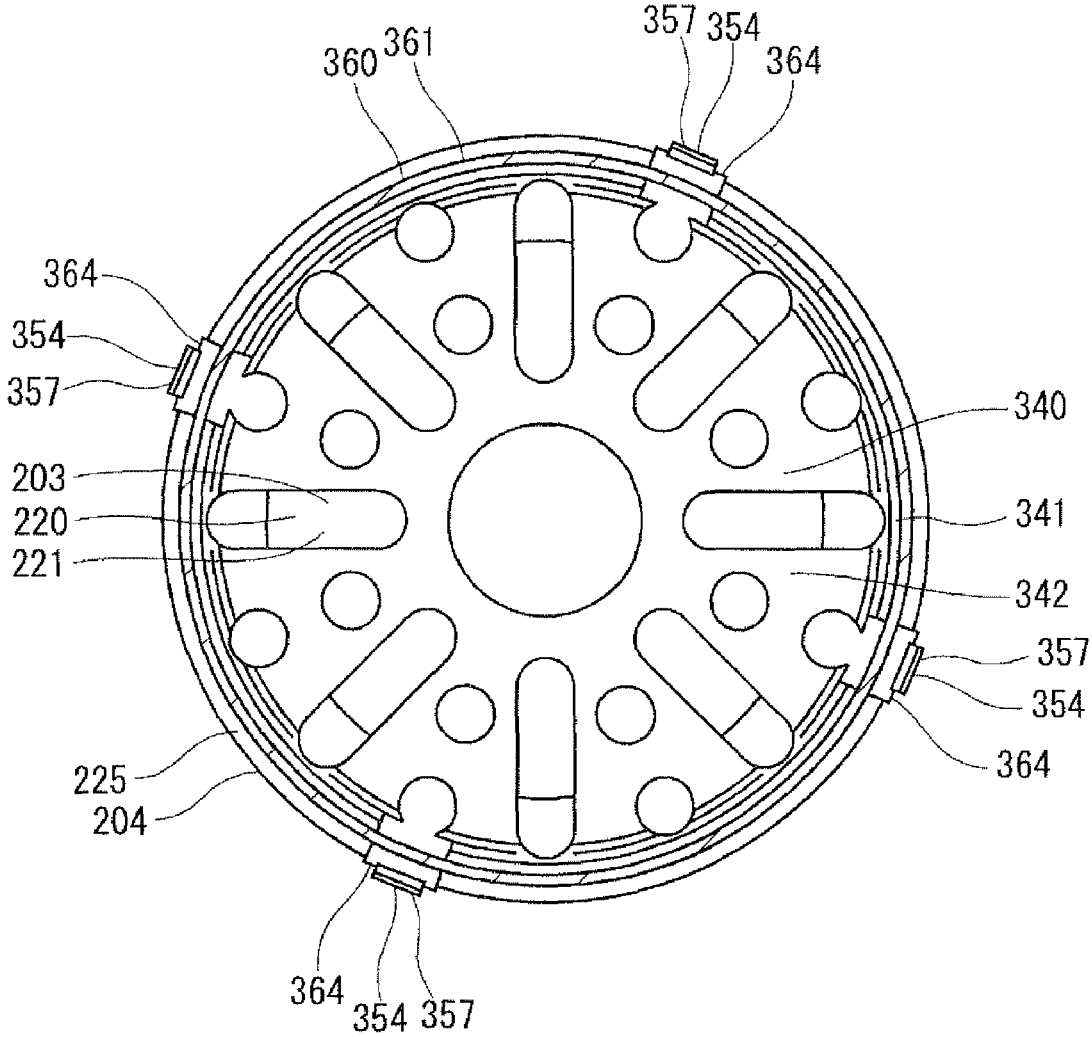
FIG. 14 is a cross-sectional view showing a portion of a damper device of a high pressure pump according to a seventh embodiment of the present invention.

FIG. 14 shows a portion of a high pressure pump according to a seventh embodiment of the present invention. In the seventh embodiment, the shapes of the first and second-side cover members are different from those of the third embodiment.

As shown in FIG. 14, in the seventh embodiment, the first-side cover member 330 and the second-side cover member 340 have the same shape as that of the first-side cover member 330 (see FIG. 7) of the second embodiment. Other than the shapes of the first-side cover member 330 and of the second-side cover member 340, the damper device 200 of the seventh embodiment is substantially the same as the damper device 200 of the third embodiment.

In the present embodiment, the first-side cover member 330 and the first-side support member 350 are integrally formed, and the second-side cover member 340 and the second-side support member 360 are integrally formed. In this way, similar to the third embodiment, it is possible to reduce the number of the components of the damper device 200, and thereby it is possible to reduce the manufacturing costs of the damper device.

In the present embodiment, when the first-side engaging portions 354 and the second-side engaging portions 364 are engaged with each other, the first-side support member 350, the first-side cover member 330, the second-side support member 360, the second-side cover member 340 and the damper member 203 are assembled together as a subassembly. In this way, similar to the third embodiment, the assembling of the damper device 200 can be eased, and the manufacturing costs of the damper device 200 can be reduced.

Now, modifications of the above embodiments will be described.

In the third and fifth to seventh embodiments, the number of the first-side engaging portions is four, and the number of the second-side engaging portions is four. In a modification of any one or more of these embodiments, the number of the first-side engaging portions and the number of the second-side engaging portions may be set to any other number (other than four) as long as the multiple first-side engaging portions and the multiple second-side engaging portions are provided. The intervals of the first-side engaging portions (and thereby of the second-side engaging portions) in the circumferential direction of the damper member are not limited to the generally equal intervals and may be changed to unequal intervals.

Furthermore, in another modification of any one or more of the above embodiments, the circular disk section of the first-side diaphragm and the circular disk section of the second-side diaphragm may have circular or annular ridges, which are concentrically arranged, to form a wavy cross section. Furthermore, the first-side concave portion of the first-side diaphragm and the second-side concave portion of the second-side diaphragm are not limited to have the dish form and may be alternatively configured into a conical form.

Also, in another modification of any one or more of the above embodiments, the pressure of the gas, which is sealed in the damper chamber of the damper member, may be set to any other desirable pressure as long as the pressure of the gas sealed in the damper chamber is equal to or higher than the atmospheric pressure. Furthermore, the gas, which is sealed in the damper chamber, is not limited to helium or argon and may be changed to any other appropriate type of gas.

In another modification of any one or more of the above embodiments, the first-side diaphragm and the second-side diaphragm may be made of a less inexpensive material, which exhibits a lower fatigue strength in comparison to the material discussed in the above embodiments. According to the above embodiments, the first-side limiting portion and the second-side limiting portion can reduce the amount of change in the stress generated in the first-side diaphragm and the second-side diaphragm. Therefore, even when the first-side diaphragm and the second-side diaphragm are made of the material, which exhibits the lower fatigue strength in comparison to the material discussed in the above embodiments, it is still possible to limit the shortening of the lifetime of the damper member. In this way, the manufacturing costs of the damper device can be reduced while maintaining the pressure pulsation reducing performance of the damper member.

As discussed above, the pressure pulsation reducing performance of the damper member may vary depending on the volume of the damper chamber of the damper member (e.g., depending on the diameter of the circular disk sections of the first and second-side diaphragms). Therefore, when the diameter of the circular disk sections (movable portions) of the first and second-side diaphragms is increased, it is possible to increase the pressure pulsation reducing performance of the damper member. Therefore, in another modification of any one or more of the above embodiments, the diameter of the circular disk sections of the first and second-side diaphragms may be increased from that of the above discussed embodiment. When the diameter of the circular disk sections of the diaphragms is increased in the case where the cover members are not provided, the bulging of the damper member in the non-operating state is increased, thereby resulting in an increase in the amount of displacement of the circular disk sections of the diaphragms at the time of changing of the state of the fluid chamber from the non-operating state to the operation start time state. Therefore, the lifetime of the damper member may possibly be reduced. However, in the present embodiment, the bulging of the damper member in the non-operating state is limited by the first-side limiting portion and the second-side limiting portion. Therefore, even when the diameter of the circular disk sections of the diaphragms is increased, it is possible to provide the predetermined lifetime of the damper member. Thereby, it is possible to further increase the pressure pulsation reducing performance of the damper device without shortening the lifetime of the damper device.

Furthermore, when the diameter of the circular disk sections of the diaphragms is increased, the desired pressure pulsation reducing performance can be implemented with the single damper member. Therefore, it is not necessary to provide multiple damper members in the fuel chamber (fluid chamber) to obtain the desired pressure pulsation reducing performance. Therefore, it is possible to reduce the number of the components of the damper device. Thereby, the manufacturing costs of the damper device can be reduced.

Furthermore, in another modification of any one or more of the above embodiments, the Belleville spring may be placed between the second-side support member and the damper housing instead of the placing the Belleville spring between the first-side support member and the opening cover member. Further alternatively, the Belleville spring may be eliminated. In such a case, the first-side support member and the cover member may be directly engaged with each other, and the second-side support member and the damper housing may be directly engaged with each other. Thereby, the cover members and the damper member may be clamped between the first-side support member and the second-side support member.

In the above embodiments, the damper device is applied to the high pressure pump installed in the vehicle. However, the present invention is not limited to the application of the damper device to the high pressure pump. For example, the damper device of the above embodiments may be applied to various apparatuses, in which it is required to damp pressure pulsation of fluid.

As discussed above, the present invention is not limited to the above embodiments, and the above embodiments may be modified within the spirit and scope of the present invention.

What is claimed is:

1. A damper device comprising:

a damper housing that has an opening at one end of the damper housing;

an opening cover member that covers the opening and forms a fluid chamber in cooperation with the damper housing, wherein the fluid chamber is adapted to conduct fluid therethrough;

a damper member that is placed in the fluid chamber and includes a first-side diaphragm and a second-side diaphragm, which are made of metal and are resiliently deformable, wherein a first-side outer peripheral portion of the first-side diaphragm and a second-side outer peripheral portion of the second-side diaphragm are joined with each other all around the first-side outer peripheral portion and the second-side outer peripheral portion to gas-tightly seal a damper chamber between a first-side concave portion of the first-side diaphragm and a second-side concave portion of the second-side diaphragm;

a first-side cover member that is provided on one side of the first-side diaphragm, which is opposite from the second-side diaphragm, and includes a first-side outer peripheral portion and a first-side limiting portion, wherein the first-side outer peripheral portion of the first-side cover member is engaged with the first-side outer peripheral portion of the first-side diaphragm, the first-side limiting portion radially inwardly extends from the first-side outer peripheral portion of the first-side cover member, wherein the first-side limiting portion includes a plurality of arms, which radially inwardly extend from the first-side outer peripheral portion of the first-side cover member, and wherein a distal end of each of the plurality of arms of the first-side limiting portion is a free end that is bendable independently from the rest of the rest of the plurality of arms of the first-side limiting portion in a direction generally perpendicular to an imaginary plane, in which the first-side outer peripheral portion of the first-side cover member extends;

a second-side cover member that is provided on one side of the second-side diaphragm, which is opposite from the first-side diaphragm, and includes a second-side outer peripheral portion and a second-side limiting portion, wherein the second-side outer peripheral portion of the second-side cover member is engaged with the second-side outer peripheral portion of the second-side diaphragm and cooperates with the first-side outer peripheral portion of the first-side cover member to clamp the first-side outer peripheral portion of the first-side diaphragm and the second-side outer peripheral portion of the second-side diaphragm between the first-side outer peripheral portion of the first-side cover member and the second-side outer peripheral portion of the second-side cover member and thereby to hold the first-side diaphragm and the second-side diaphragm on an inner side of the first-side cover member and the second-side cover member, and the second-side limiting portion radially inwardly extends from the second-side outer peripheral portion of the second-side cover member;

a first-side support member that is configured into a generally tubular form and is placed between the first-side cover member and the opening cover member, wherein the first-side support member urges the first-side outer peripheral portion of the first-side cover member toward the first-side outer peripheral portion of the first-side diaphragm; and a second-side support member that is configured into a generally tubular form and is placed between the second-side cover member and the damper housing, wherein the second-side support member urges the second-side outer peripheral portion of the second-side cover member toward the second-side outer peripheral portion of the second-side diaphragm to clamp the first-side outer peripheral portion of the first-side cover member, the first-side outer peripheral portion of the first-side diaphragm, the second-side outer peripheral portion of the second-side diaphragm and the second-side outer peripheral portion of the second-side cover member between the first-side support member and the second-side support member, wherein:

gas of a predetermined pressure, which is equal to or higher than an atmospheric pressure, is filled and sealed in the damper chamber of the damper member; and the first-side limiting portion and the second-side limiting portion are engageable with the first-side concave portion and the second-side concave portion, respectively, to limit bulging of the damper member when a pressure of the fluid chamber is equal to or less than the predetermined pressure.

2. The damper device according to claim 1, wherein:

the pressure of the fluid chamber is variable within a predetermined pressure range;

the predetermined pressure of the gas, which is filled in the damper chamber of the damper member, is lower than a lower limit value of the predetermined pressure range; and the first-side limiting portion and the second-side limiting portion are kept spaced away from a center of the first-side concave portion and a center of the second-side concave portion, respectively, when the pressure of the fluid chamber varies within the predetermined pressure range.

3. The damper device according to claim 1, wherein:

the second-side limiting portion radially inwardly extends from the second-side outer peripheral portion of the second-side cover member and is configured to cover the second-side concave portion; and the second-side limiting portion includes a plurality of through holes that communicate between one side of the second-side limiting portion, at which the second-side concave portion is located, and the other side of the second-side limiting portion, which is opposite from the second-side concave portion.

4. The damper device according to claim 1, wherein:

the first-side cover member and the first-side support member are integrally formed; and the first-side outer peripheral portion of the first-side cover member and one end part of the first-side support member, which is adjacent to the first-side cover member, are joined together.

5. The damper device according to claim 1, wherein:

the second-side cover member and the second-side support member are integrally formed;

the second-side outer peripheral portion of the second-side cover member and one end part of the second-side support member, which is adjacent to the second-side cover member, are joined together.

6. The damper device according to claim 1, wherein:

the first-side support member includes a plurality of first-side engaging portions, which radially outwardly project;

the second-side support member includes a plurality of second-side engaging portions, which radially outwardly project and are placed to correspond with the plurality of first-side engaging portions, respectively, of the first-side support member; and each of the plurality of first-side engaging portions of the first-side support member is engaged with a corresponding one of the plurality of second-side engaging portions of the second-side support member to hold the damper member between the first-side support member and the second-side support member through the first-side cover member and the second-side cover member.

7. The damper device according to claim 1, wherein:

the first-side cover member includes a plurality of first-side engaging portions, which radially outwardly project;

the second-side cover member includes a plurality of second-side engaging portions, which radially outwardly project and are placed to correspond with the plurality of first-side engaging portions, respectively, of the first-side cover member; and each of the plurality of first-side engaging portions of the first-side cover member is engaged with a corresponding one of the plurality of second-side engaging portions of the second-side cover member to hold the damper member between the first-side cover member and the second-side cover member.

8. The damper device according to claim 1, wherein:

one side of the first-side limiting portion, which is adjacent to the damper member, is coated with fluoroplastic; and one side of the second-side limiting portion, which is adjacent to the damper member, is coated with fluoroplastic.

9. A high pressure pump comprising:

the damper device recited in claim 1;

a housing that includes a pressurizing chamber, which is communicated with the fluid chamber; and a plunger that is received in the housing and is adapted to reciprocate in the housing to pressurize fluid in the pressurizing chamber.

10. A manufacturing method for manufacturing the high pressure pump recited in claim 9, comprising:

filling gas of a predetermined pressure, which is equal to or higher than an atmospheric pressure, into the damper chamber of the damper member, wherein a pressure of the fluid chamber is variable within a predetermined pressure range during operation of the high pressure pump, and the predetermined pressure of the gas is lower than a lower limit value of the predetermined pressure range.

11. The damper device according to claim 1, wherein the first-side outer peripheral portion of the first-side diaphragm and the second-side outer peripheral portion of the second-side diaphragm are welded with each other all around the first-side outer peripheral portion and the second-side outer peripheral portion.

12. A damper device comprising:

a damper housing that has an opening at one end of the damper housing;

an opening cover member that covers the opening and forms a fluid chamber in cooperation with the damper housing, wherein the fluid chamber is adapted to conduct fluid therethrough;

a damper member that is placed in the fluid chamber and includes a first-side diaphragm and a second-side diaphragm, which are made of metal and are resiliently deformable, wherein a first-side outer peripheral portion of the first-side diaphragm and a second-side outer peripheral portion of the second-side diaphragm are joined with each other all around the first-side outer peripheral portion and the second-side outer peripheral portion to gas-tightly seal a damper chamber between a first-side concave portion of the first-side diaphragm and a second-side concave portion of the second-side diaphragm;

a first-side cover member that is provided on one side of the first-side diaphragm, which is opposite from the second-side diaphragm, and includes a first-side outer peripheral portion and a plurality of arms, wherein the first-side outer peripheral portion of the first-side cover member is engaged with the first-side outer peripheral portion of the first-side diaphragm, and each of the plurality of arms of the first-side cover member has a free end that is bendable independently from the rest of the plurality of arms of the first-side cover member in a direction generally perpendicular to an imaginary plane, in which the first-side outer peripheral portion extends; and a second-side cover member that is provided on one side of the second-side diaphragm, which is opposite from the first-side diaphragm, and includes a second-side outer peripheral portion and a plurality of arms, wherein:

the second-side outer peripheral portion of the second-side cover member is engaged with the second-side outer peripheral portion of the second-side diaphragm and cooperates with the first-side outer peripheral portion of the first-side cover member to clamp the first-side outer peripheral portion of the first-side diaphragm and the second-side outer peripheral portion of the second-side diaphragm between the first-side outer peripheral portion of the first-side cover member and the second-side outer peripheral portion of the second-side cover member and thereby to hold the first-side diaphragm and the second-side diaphragm on an inner side of the first-side cover member and the second-side cover member;

each of the plurality of arms of the second-side cover member has a free end that is bendable independently from the rest of the plurality of arms of the second-side cover member in a direction generally perpendicular to an imaginary plane, in which the second-side outer peripheral portion extends; and gas of a predetermined pressure, which is equal to or higher than an atmospheric pressure, is filled and sealed in the damper chamber of the damper member.

13. The damper device according to claim 12, wherein the first-side outer peripheral portion of the first-side diaphragm and the second-side outer peripheral portion of the second-side diaphragm are welded with each other all around the first-side outer peripheral portion and the second-side outer peripheral portion.

14. A damper device comprising:

a damper housing that has an opening at one end of the damper housing;

an opening cover member that covers the opening and forms a fluid chamber in cooperation with the damper housing, wherein the fluid chamber is adapted to conduct fluid therethrough;

a damper member that is placed in the fluid chamber and includes a first-side diaphragm and a second-side diaphragm, which are made of metal and are resiliently deformable, wherein a first-side outer peripheral portion of the first-side diaphragm and a second-side outer peripheral portion of the second-side diaphragm are joined with each other all around the first-side outer peripheral portion and the second-side outer peripheral portion to gas-tightly seal a damper chamber between a first-side concave portion of the first-side diaphragm and a second-side concave portion of the second-side diaphragm;

a first-side cover member that is provided on one side of the first-side diaphragm, which is opposite from the second-side diaphragm, and includes a first-side outer peripheral portion and a first-side limiting portion, wherein the first-side outer peripheral portion of the first-side cover member is engaged with the first-side outer peripheral portion of the first-side diaphragm, the first-side limiting portion radially inwardly extends from the first-side outer peripheral portion of the first-side cover member;

a second-side cover member that is provided on one side of the second-side diaphragm, which is opposite from the first-side diaphragm, and includes a second-side outer peripheral portion and a second-side limiting portion, wherein the second-side outer peripheral portion of the second-side cover member is engaged with the second-side outer peripheral portion of the second-side diaphragm and cooperates with the first-side outer peripheral portion of the first-side cover member to clamp the first-side outer peripheral portion of the first-side diaphragm and the second-side outer peripheral portion of the second-side diaphragm between the first-side outer peripheral portion of the first-side cover member and the second-side outer peripheral portion of the second-side cover member and thereby to hold the first-side diaphragm and the second-side diaphragm on an inner side of the first-side cover member and the second-side cover member, and the second-side limiting portion radially inwardly extends from the second-side outer peripheral portion of the second-side cover member, wherein the second-side limiting portion includes a plurality of arms, which radially inwardly extend from the second-side outer peripheral portion of the second-side cover member, and wherein a distal end of each of the plurality of arms of the second-side limiting portion is a free end that is bendable independently from the rest of the plurality of arms of the second-side limiting portion in a direction generally perpendicular to an imaginary plane, in which the second-side outer peripheral portion of the second-side cover member extends;

a first-side support member that is configured into a generally tubular form and is placed between the first-side cover member and the opening cover member, wherein the first-side support member urges the first-side outer peripheral portion of the first-side cover member toward the first-side outer peripheral portion of the first-side diaphragm; and a second-side support member that is configured into a generally tubular form and is placed between the second-side cover member and the damper housing, wherein the second-side support member urges the second-side outer peripheral portion of the second-side cover member toward the second-side outer peripheral portion of the second-side diaphragm to clamp the first-side outer peripheral portion of the first-side cover member, the first-side outer peripheral portion of the first-side diaphragm, the second-side outer peripheral portion of the second-side diaphragm and the second-side outer peripheral portion of the second-side cover member between the first-side support member and the second-side support member, wherein:

gas of a predetermined pressure, which is equal to or higher than an atmospheric pressure, is filled and sealed in the damper chamber of the damper member; and the first-side limiting portion and the second-side limiting portion are engageable with the first-side concave portion and the second-side concave portion, respectively, to limit bulging of the damper member when a pressure of the fluid chamber is equal to or less than the predetermined pressure.

15. The damper device according to claim 14, wherein:

the pressure of the fluid chamber is variable within a predetermined pressure range;

the predetermined pressure of the gas, which is filled in the damper chamber of the damper member, is lower than a lower limit value of the predetermined pressure range; and the first-side limiting portion and the second-side limiting portion are kept spaced away from a center of the first-side concave portion and a center of the second-side concave portion, respectively, when the pressure of the fluid chamber varies within the predetermined pressure range.

16. The damper device according to claim 14, wherein:

the first-side limiting portion radially inwardly extends from the first-side outer peripheral portion of the first-side cover member and is configured to cover the first-side concave portion; and the first-side limiting portion includes a plurality of through holes that communicate between one side of the first-side limiting portion, at which the first-side concave portion is located, and the other side of the first-side limiting portion, which is opposite from the first-side concave portion.

17. The damper device according to claim 14, wherein:

the first-side cover member and the first-side support member are integrally formed; and the first-side outer peripheral portion of the first-side cover member and one end part of the first-side support member, which is adjacent to the first-side cover member, are joined together.

18. The damper device according to claim 14, wherein:

the second-side cover member and the second-side support member are integrally formed;

the second-side outer peripheral portion of the second-side cover member and one end part of the second-side support member, which is adjacent to the second-side cover member, are joined together.

19. The damper device according to claim 14, wherein:

the first-side support member includes a plurality of first-side engaging portions, which radially outwardly project;

the second-side support member includes a plurality of second-side engaging portions, which radially outwardly project and are placed to correspond with the plurality of first-side engaging portions, respectively, of the first-side support member; and each of the plurality of first-side engaging portions of the first-side support member is engaged with a corresponding one of the plurality of second-side engaging portions of the second-side support member to hold the damper member between the first-side support member and the second-side support member through the first-side cover member and the second-side cover member.

20. The damper device according to claim 14, wherein:

the first-side cover member includes a plurality of first-side engaging portions, which radially outwardly project;

the second-side cover member includes a plurality of second-side engaging portions, which radially outwardly project and are placed to correspond with the plurality of first-side engaging portions, respectively, of the first-side cover member; and each of the plurality of first-side engaging portions of the first-side cover member is engaged with a corresponding one of the plurality of second-side engaging portions of the second-side cover member to hold the damper member between the first-side cover member and the second-side cover member.

21. The damper device according to claim 14, wherein:

one side of the first-side limiting portion, which is adjacent to the damper member, is coated with fluoroplastic; and one side of the second-side limiting portion, which is adjacent to the damper member, is coated with fluoroplastic.

22. A high pressure pump comprising:

the damper device recited in claim 1;

a housing that includes a pressurizing chamber, which is communicated with the fluid chamber; and a plunger that is received in the housing and is adapted to reciprocate in the housing to pressurize fluid in the pressurizing chamber.

23. A manufacturing method for manufacturing the high pressure pump recited in claim 22, comprising:

filling gas of a predetermined pressure, which is equal to or higher than an atmospheric pressure, into the damper chamber of the damper member, wherein a pressure of the fluid chamber is variable within a predetermined pressure range during operation of the high pressure pump, and the predetermined pressure of the gas is lower than a lower limit value of the predetermined pressure range.

* * * * *